US007381093B2

(12) United States Patent
Shimamori et al.

(10) Patent No.: US 7,381,093 B2
(45) Date of Patent: Jun. 3, 2008

(54) COVERED SNAP-FIT TERMINALS FOR CONNECTING STORAGE CELLS TOGETHER

(75) Inventors: Masato Shimamori, Tokyo (JP); Tomoyuki Okada, Tokyo (JP); Hisashi Katoh, Wako (JP); Koichi Yamamoto, Wako (JP); Shuji Sasaki, Wako (JP); Kenji Hasegawa, Tokyo (JP); Munemasa Oobayashi, Tokyo (JP); Norifumi Yasuda, Wako (JP); Makoto Kawahara, Wako (JP)

(73) Assignees: YKK Corporation, Tokyo (JP); Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/434,831

(22) Filed: May 16, 2006

(65) Prior Publication Data

US 2006/0264108 A1 Nov. 23, 2006

(30) Foreign Application Priority Data

May 17, 2005 (JP) ..... 2005-144446
May 17, 2005 (JP) ..... 2005-144516
May 17, 2005 (JP) ..... 2005-144517
May 17, 2005 (JP) ..... 2005-144518
May 17, 2005 (JP) ..... 2005-144519

(51) Int. Cl.
*H01R 24/00* (2006.01)

(52) U.S. Cl. ..... 439/627; 429/178; 429/179; 439/500

(58) Field of Classification Search ..... 439/627, 439/500, 504; 429/179, 178
See application file for complete search history.

(56) References Cited

U.S. PATENT DOCUMENTS 4,295,705 A * 10/1981 Ciliberti, Jr. ..... 439/389
5,197,889 A * 3/1993 Rizzo et al. ..... 439/76.1
5,496,657 A * 3/1996 Dixon, Jr. ..... 429/62
5,900,332 A * 5/1999 Marukawa et al. ..... 429/158
5,985,480 A * 11/1999 Sato et al. ..... 429/65

(Continued)

FOREIGN PATENT DOCUMENTS

| | | |
|---|---|---|
| JP | 6-5111 | 1/1994 |
| JP | 7-36436 | 7/1995 |
| JP | 8-222201 | 8/1996 |
| JP | 9-92238 | 4/1997 |
| JP | 10-125559 | 5/1998 |
| JP | 2000-77057 | 3/2000 |
| JP | 2000-123819 | 4/2000 |

*Primary Examiner*—Tho D. Ta
*Assistant Examiner*—Vanessa Girardi
(74) *Attorney, Agent, or Firm*—Alston & Bird LLP

(57) ABSTRACT

An electric connector of the snap-in-fitting system comprises a couple of male and female connector members both made of an electrically-conductive material. The female connector member has a female engaging part or outer ring part for snap-in-fitting and the male connector member has a male engaging part or outer ring part to be fitted in and engaged with the female engaging part by snap-in-fitting. The interaction part in snap-in-fitting of the male engaging part and the female engaging part is an inclined engaging surface and adapted to apply load to the female engaging part so as to always urge the female engaging part outward. Preferably, the inclined engaging surface is a tapered surface convergent toward the male connector member side. Such an electric connector of the snap-in-fitting system is useful for the connection of a storage power supply unit of an electric vehicle and of a battery unit of a portable type electronic device, particularly an ultra capacitor or a storage cell (capacitor cell) of a battery.

26 Claims, 24 Drawing Sheets

U.S. PATENT DOCUMENTS 5,998,060 A * 12/1999 McGrady ..... 429/121
6,607,400 B1 * 8/2003 Ko ..... 439/581
6,632,562 B1 * 10/2003 Nakatsuka et al. ..... 429/158
6,676,455 B2 * 1/2004 Machado ..... 439/855
6,776,669 B2 * 8/2004 Krause et al. ..... 439/772
6,817,893 B2 * 11/2004 Schmid et al. ..... 439/522

* cited by examiner

COVERED SNAP-FIT TERMINALS FOR CONNECTING STORAGE CELLS TOGETHER

BACKGROUND OF THE INVENTION

1. Field of the Invention

This invention relates to an electric connector which electrically connects terminals to each other and electric wires, and more specifically to a connector of a snap-in-fitting system.

The present invention also relates to a unit for covering the connected part between terminals electrically connected by snap-in-fitting and an apparatus for connecting terminals using the same.

The present invention further relates to a storage cell using the electric connector of the snap-in-fitting system mentioned above, a storage module containing a plurality of storage cells connected to each other, and a storage apparatus equipped with a plurality of storage modules.

The present invention further relates to a connection structure of storage cells and a bus bar equipped with the connection structure.

2. Description of the Prior Art

A plug-socket type connector is generally used as a connector which electrically connects the terminals of the storage cells or storage elements to each other and electric wires.

Further, the terminal structure of the fitting type in which a protruded part formed in the terminal of one end of a storage cell body is fitted into a concave portion formed in the terminal of the other end of the other storage cell body has been known as disclosed in published Japanese Utility Model Application, KOKAI (Early Publication) No. (hereinafter referred to briefly as "JUM-A-") 6-5111, published Japanese Patent Application, KOKAI (Early Publication) No. (hereinafter referred to briefly as "JP-A-") 2000-123819, and JUM-A-7-36436, for example. According to such terminal structure of the fitting system, it is possible to improve the workability and reduce the production cost because the terminals can be connected by one push operation. However, there is a problem that a large electric current cannot be passed therethrough because the contact surface of terminals cannot be enlarged and a current path thereof is small.

Further, storage cells, such as single cells like a nickel hydrogen cell and a lithium cell, and energy storage elements like an electric double layer capacitor, are used for electric vehicles, hybrid electric vehicles, etc. as a driving power source. For example, as storage power supply unit of an electric vehicle, a storage apparatus called an ultra capacitor has been known. This storage apparatus is equipped with some hundreds of capacitor cells which store or discharge electric power (refer to JP-A-10-125559, for example).

In assembling such an ultra capacitor, since the electric wiring for electrically connecting terminals should be carried out after fixing capacitor cells in the positions close to each other, there is a problem that considerable labor hour and cost will be required for the assembly. For example, in one ultra capacitor, since welding and electric wiring will be performed for about hundreds of capacitor cells, the labor hours and cost required therefor are unfathomable.

Moreover, since the capacitor cells which constitute an ultra capacitor are fixed by a non-detachable fixing method, such as welding, it is impossible to disassemble the ultra capacitor to discrete capacitor cells and to reassemble them.

Accordingly, when any fault arises in either of the capacitor cells, all the capacitor cells should be discarded.

Therefore, a method of interposing and fixedly securing a bus bar or a conductor wire, for connecting a plurality of storage cells to each other between a terminal having a male screw part in one end of a storage cell body and a bolt to be fastened thereto has been proposed, as disclosed in JP-A-9-92238, for example. However, according to the technique disclosed in JP-A-9-92238, since the male screw part is thin, a large electric current cannot be passed therethrough. Moreover, since the connection is done by bolting, workability is poor and further the production cost becomes high because a screw part should be formed on the terminal. Further, the terminal structure of the screw type in which a male screw part formed in the terminal of one end of a storage cell body is screwed into a female screw part formed in the terminal of the other end of a storage cell body has been proposed, as disclosed in JP-A-8-222201 and JP-A-2000-77057. However, according to such terminal structure of the screw type, since a screw is fastened onto a male screw part, the workability of connecting storage cells is poor because of the screwing operation and the production cost becomes high because a screw part should be formed on the terminal.

As described above, the conventional connection structure of the storage cells has failed to realize simultaneously all the improved workability, reduction in production cost, and the passing of a large electric current. Such a problem also holds good for the case where a plurality of storage cells are connected to each other by the use of a bus bar.

SUMMARY OF THE INVENTION

Although the terminal structure of the fitting type in which a protruded part formed in the terminal of one end of a storage cell body is fitted into a concave portion formed in the terminal of the other end of the other storage cell body has been known in the art as described above, the connector of the snap-in-fitting system has not been known as a connector for electrically joining terminals. This is because a clearance is produced between a female connector member and a male connector member, as being clear from the case of a snap button, though the connector of the snap-in-fitting system has a significantly great advantage that they are joinable without adjusting the angle around their axis. Generally in the case of snap-in-fitting, the protruded part of a male connector member is fitted into the concave portion of a female connector member thereby assuming the engagement state. Since the interaction area of engagement is dot-like or linear, a clearance will be inevitably produced between the female connector member and the male connector member. The reason for making such a structure of causing a clearance is thought that, in the case of the snap button for clothes, for example, the difference in pitch of the attachment of buttons should be absorbed and a user wishes to have the feeling at the time of engagement. Moreover, in the case of the snap button for clothes, it is necessary not only to make easy to frequently perform the engagement operation but also to make easy to perform the disengagement operation. As a result, the looseness will be produced, and thus it is not suitable for the electric connection because the resistance becomes large.

An object of the present invention, therefore, is to provide an electric connector of a snap-in-fitting system which can electrically connect terminals to each other with a simple operation, can establish close contact thereof without producing looseness, exhibits small resistance and thus can establish a good electric connection.

As a material of the electric connector of such a snap-in-fitting system, a copper-based material which has good electrical conductivity and proper softness in combination is suitable. However, as a terminal of a storage cell, for example, aluminum-based material is generally used. Therefore, when copper which exhibits a low ionization tendency is used as a base material of a connector which is brought into contact with the terminal made of aluminum which exhibits a high ionization tendency, there is a problem that the thickness of the aluminum terminal will decrease due to the electrolytic corrosion action.

Accordingly, a further object of the present invention is to provide an electric connector which enjoys excellent electrical conductivity and corrosion resistance, can electrically connect terminals to each other with a simple operation, and can keep the connection stably for a long period of time, without posing the problem mentioned above.

Owing to the development of such an electric connector of the snap-in-fitting system, the problems of the prior art described above may be solved. However, since the connector is small as compared with a storage cell, it is not easy to see it at the time of attachment and detachment, the center positions of the male and female connector members may deviate, or the engaging parts may be damaged depending on the circumstances. Accordingly, there is room for further improvement in the operation characteristics at the time of engagement. Moreover, when dust or liquid is attached to a connector or its connection part to a terminal, its electrical resistance becomes large or variation arises in conductivity, thereby tending to impair good electric connection. Accordingly, there is room for improvement also in dust proofness and drip proofness.

Another object of the present invention, therefore, is to provide a unit for covering the connected part between the terminals electrically connected by snap-in-fitting, which unit allows the fixation of the relative positions of the respective terminals of the storage cells and simultaneously the electrical connection of the terminals to each other by a simple operation, and improves the operation characteristics at the time of engagement, the dust proofness, and the drip proofness, while maintaining the advantages of the electric connector of the snap-in-fitting system as mentioned above, and to provide an apparatus for connecting terminals using the same.

The electric connector of the snap-in-fitting system mentioned above is useful for the connection of a storage power supply unit of an electric vehicle, such as an ultra capacitor, for example, and also as a connector of the snap-in-fitting system which performs the connection of a battery unit of a portable type electronic device, for example, particularly an ultra capacitor or a storage cell (capacitor cell) of a battery or the like.

Therefore, still another object of the present invention is to provide a detachable storage cell which, by the use of the above-mentioned electric connector as a connector for storage cells, allows the electrical connection of the terminals to each other simultaneously with the fixation of the relative positions of the respective terminals of the storage cells by a simple operation.

A further object of the present invention is to provide a storage module which, by the use of a plurality of such storage cells, allows easy assembly or disassembly and also enjoys easy maintenance such as the disassembly of the storage apparatus and exchange of the broken storage cell, and to provide a storage apparatus equipped with the same.

Still another object of the present invention is to provide a connection structure of storage cells which can pass a large electric current and naturally enjoys the improvement in workability of connecting a plurality of elements and the reduction in production cost, and to provide a bus bar equipped with the connection structure.

To accomplish the objects described above, the first aspect of the present invention provides an electric connector. The fundamental embodiment thereof is an electric connector comprising a couple of male and female connector members both made of an electrically-conductive material, characterized in that the female connector member mentioned above has a female engaging part for snap-in-fitting and the male connector member mentioned above has a male engaging part to be fitted in and engaged with the above-mentioned female engaging part by snap-in-fitting, wherein the interaction area in snap-in-fitting of the male engaging part and the female engaging part mentioned above is an inclined engaging surface and adapted to apply load to the female engaging part so as to always urge the female engaging part outward. In a preferred embodiment, the inclined engaging surface mentioned above is a tapered surface convergent toward the male connector member side.

Another embodiment of the electric connector of the present invention is a connector for storage cells, wherein the male connector member and the female connector member mentioned above have an attachment part for attaching to a terminal, respectively. An electric connector inclusive of the connector for storage cells is hereafter generally referred to as a "connector" simply.

In a more concrete embodiment, the above-mentioned male connector member comprises a base part having an inner hole which allows a terminal to be inserted therein, a female screw part formed in the inner circumferential surface around the inner hole, and the male engaging part standing from the above-mentioned base part so as to surround the inner hole mentioned above, and the above-mentioned female connector member comprises a base part having an inner hole which allows a terminal to be inserted therein, a female screw part formed in the inner circumferential surface around the inner hole, and the female engaging part standing from the above-mentioned base part so as to surround the inner hole mentioned above.

In a more preferred embodiment, at least one of the male connector member and the female connector member mentioned above has an inner ring part standing from the inner circumferential edge around the inner hole of the base part mentioned above, and the above-mentioned female screw part is formed in the inner circumferential surface of the inner ring part.

According to a still more preferred embodiment of the connector of the present invention, at least one of the female connector member and the male connector member has a Ni plating layer and a Cu—Sn plating layer formed sequentially in the order mentioned on a copper-based base material, respectively. Preferably, a Sn plating layer is further formed on the above-mentioned Cu—Sn plating layer.

In accordance with the second aspect of the present invention, there is provided a unit for covering the connected part between terminals electrically connected by snap-in-fitting, characterized in that it comprises a couple of male and female cover members each having a base plate containing an opening in the center thereof and a circumferential wall part of a predetermined height standing from the periphery thereof, wherein the circumferential wall part of the male cover member mentioned above is adapted to be guided into the circumferential wall part of the female cover member. In a preferred embodiment, the circumferential wall part of the male cover member mentioned above is adapted to be fitted in the circumferential wall part of the female cover member to effect snap-in-fitting.

According to another aspect of the present invention, there is further provided an apparatus for connecting terminals to be electrically connected by snap-in-fitting, characterized in that it comprises a pair of terminals, the connector mentioned above, and the above-mentioned cover unit for the connected part between terminals, wherein the male cover member and the female cover member of the cover unit are attached to the respective terminals in the state of being nipped between either of the terminals mentioned above and either of the male connector member or the female connector member of the connector mentioned above.

According to the third aspect of the present invention, there is provided a storage cell characterized in that it comprises a pair of terminals for inputting and outputting electric power and the connector mentioned above, wherein the male connector member of the above-mentioned connector is attached to one terminal and the female connector member is attached to the other terminal. Preferably, it further comprises the above-mentioned cover unit for the connected part between terminals, and the male cover member and the female cover member of the cover unit are attached to the respective terminals in the state of being nipped between either of the terminals mentioned above and either of the male connector member or the female connector member of the connector mentioned above.

Furthermore, according to the fourth aspect of the present invention, there is provided a storage module characterized in that it comprises two or more storage cells, each having a pair of terminals for inputting and outputting electric power, for storing and discharging electric power through the terminals, and the above-mentioned connectors, wherein the storage cells mentioned above are adapted to be electrically connected to each other simultaneously with the fixation of the relative positions of the respective terminals mentioned above by the above-mentioned connector.

In a preferred embodiment, the above-mentioned storage cells have respective circumferential wall parts which define a connection space containing the above-mentioned terminals by surrounding the terminals at their side positions when two storage cells having respective terminals in opposed to each other come to close, and the above-mentioned connector lies in the closed connection space when the terminals mentioned above are electrically connected to each other by the above-mentioned connector. Preferably, the storage cell has the above-mentioned cover unit for the connected part between terminals, and the male cover member and the female cover member of this cover unit are attached to the respective terminals in the state of being nipped between either of the terminals mentioned above and either of the male connector member or the female connector member of the connector mentioned above.

According to the fifth aspect of the present invention, there is provided a storage apparatus equipped with a plurality of storage modules mentioned above.

Further, according to the sixth aspect of the present invention, there is provided a connection structure of storage cells characterized in that it comprises a male connector member to be attached to one terminal of the storage cell and having an outer ring part and an inner ring part formed inside this outer ring part; and a female connector member to be attached to the other terminal of the storage cell and having an outer ring part and an inner ring part formed inside this outer ring part; wherein the above-mentioned male connector member and the above-mentioned female connector member are connected to each other by abutting an end face of the inner ring part of the male connector member mentioned above faced to the axial direction thereof and an end face of the inner ring part of the female connector member mentioned above faced to the axial direction thereof against each other and press-fitting the outer circumferential surface of the outer ring part of the male connector member mentioned above and the inner circumferential surface of the outer ring part of the female connector member mentioned above to each other.

Further, according to the seventh aspect of the present invention, there is provided a bus bar characterized in that it comprises a bus bar plate and the connector mentioned above, wherein the male connector member of the connector mentioned above is fixedly secured to one end portion of the bus bar plate mentioned above and the female connector member is fixedly secured to the other end portion of the bus bar plate mentioned above.

Since the connector of the present invention is so constructed that the interaction area in snap-in-fitting of the male engaging part of the male connector member and the female engaging part of the female connector member is an inclined engaging surface and adapted to apply load to the female engaging part so as to always urge the female engaging part outward, it is possible to establish close contact thereof without producing looseness, the electrical resistance becomes small, and thus a good electric connection may be established. Further, since the electrical resistance becomes small, such a problems as the generation of heat will not arise. Moreover, since the terminals can be engaged and disengaged with each other by the snap operation, wiring work is very simple. Therefore, the outstanding cost reduction effect may be obtained because the working efficiency may be improved sharply and further the maintenance can be done simply.

By using the connector of the present invention as a connector for storage cells, a plurality of storage cells can be detachably connected very easily by attaching the male connector member to one terminal of the storage cell and the female connector member to the other terminal thereof, and thus the electric wiring between terminals becomes unnecessary. Moreover, since the terminals can be engaged and disengaged by the snap operation, the assembly work and the disassembly work are very simple. Particularly in the case that a storage apparatus is an ultra capacitor, since 50 or more storage cells should be connected to each other, the above effect becomes very large and the assembly efficiency can be markedly improved. Moreover, since the disengagement thereof can be carried out by the snap operation, it is possible to disassemble the storage apparatus easily, and the maintenance thereof such as removal of the broken storage cell and exchange for a new storage cell can also performed easily. Since the working efficiency is improved in this way and further the maintenance becomes simple, the outstanding cost reduction effect is obtained.

According to a preferred embodiment of the connector of the present invention, since the Ni plating layer and the Cu—Sn plating layer are formed sequentially in this order on the copper-based base material, preferably the Sn plating layer is further formed thereon, it excels in electrical conductivity and corrosion resistance, and even when an aluminum terminal etc. is used as the terminals for a storage cell etc., there is no problem of causing the reduction in thickness thereof due to the electrolytic corrosion action.

Since the cover unit for the connected part between terminals according to the present invention is so constructed that the connection between terminals by means of the connector is done by the snap-in-fitting and the male and female cover members guide each other, the male cover member and the female cover member of cover unit function as the centering guide at the time of snap-in-fitting. As a result, the operation characteristics at the time of engagement is markedly improved and such problems as the deviation of the center positions of the male and female connector members and the damages of the engaging parts may be solved. Further, since the closed space is formed by the male cover member and the female cover member when the male cover member of cover unit is guided into the female cover member and the connected part between terminals by means of the male and female connector members lies in this space, the dust proofness and the drip proofness are greatly improved, and the attachment of dust and liquid to the connected part between terminals is prevented effectively.

Further, by the use of the storage cells having the male connector member of the above-mentioned connector attached to one terminal thereof and the female connector member attached to the other terminal, the storage cells are electrically connected to each other simultaneously with the fixation of the relative positions of the respective terminals by the above-mentioned connector. Accordingly, a storage module can be assembled easily, and removal of individual storage cells at the time of being out of order is also very easy. Moreover, by the use of a plurality of such storage modules, it is possible to operate the storage apparatus stably and increase its reliability.

Further, according to the connection structure of the storage cells of the present invention, since in the state of connection of the male connector member with the female connector member the respective end faces of the inner ring parts of the male connector member and the female connector member faced to the axial direction thereof abut against each other, it is possible to effect their positioning in the axial direction. By properly designing the respective pressing parts in the outer circumferential surface of the outer ring part of the male connector member and in the inner circumferential surface of the outer ring part of the female connector member, even when the high load generates therebetween, the positions of the mutually pressed parts of the inner ring parts of the male and female connector members may be maintained. Accordingly, it is possible to prevent the inner ring parts from the generation of looseness thereof due to the displacement thereof in the direction canceling the generated load, and thus the connection resistance may be decreased. Furthermore, since the counterforce generates in the mutually abutted end faces of the inner ring parts of the male connector member and the female connector member, the relative turning of the male connector member and the female connector member may be prevented. In addition, since a current path is formed between the mutually abutted end faces of the inner ring parts of the male connector member and the female connector member and a further current path is formed between the outer circumferential surface of the outer ring part of the male connector member and the inner circumferential surface of the outer ring part of the female connector member, the male connector member and the female connector member have two current paths formed in the outer ring parts and the inner ring parts, respectively. Therefore, since the area in which an electric current flows may be enlarged, a large electric current may be passed therethrough.

Further, by the use of the bus bar comprising the male connector member of the connector mentioned above fixedly secured to one end portion of the bus bar plate and the female connector member fixedly secured to the other end portion of the bus bar plate mentioned above, the storage module as described above may be easily assembled.

BRIEF DESCRIPTION OF THE DRAWINGS

Other objects, features, and advantages of the invention will become apparent from the following description taken together with the drawings, in which.

DETAILED DESCRIPTION OF THE PREFERRED EMBODIMENTS

Figure 1:
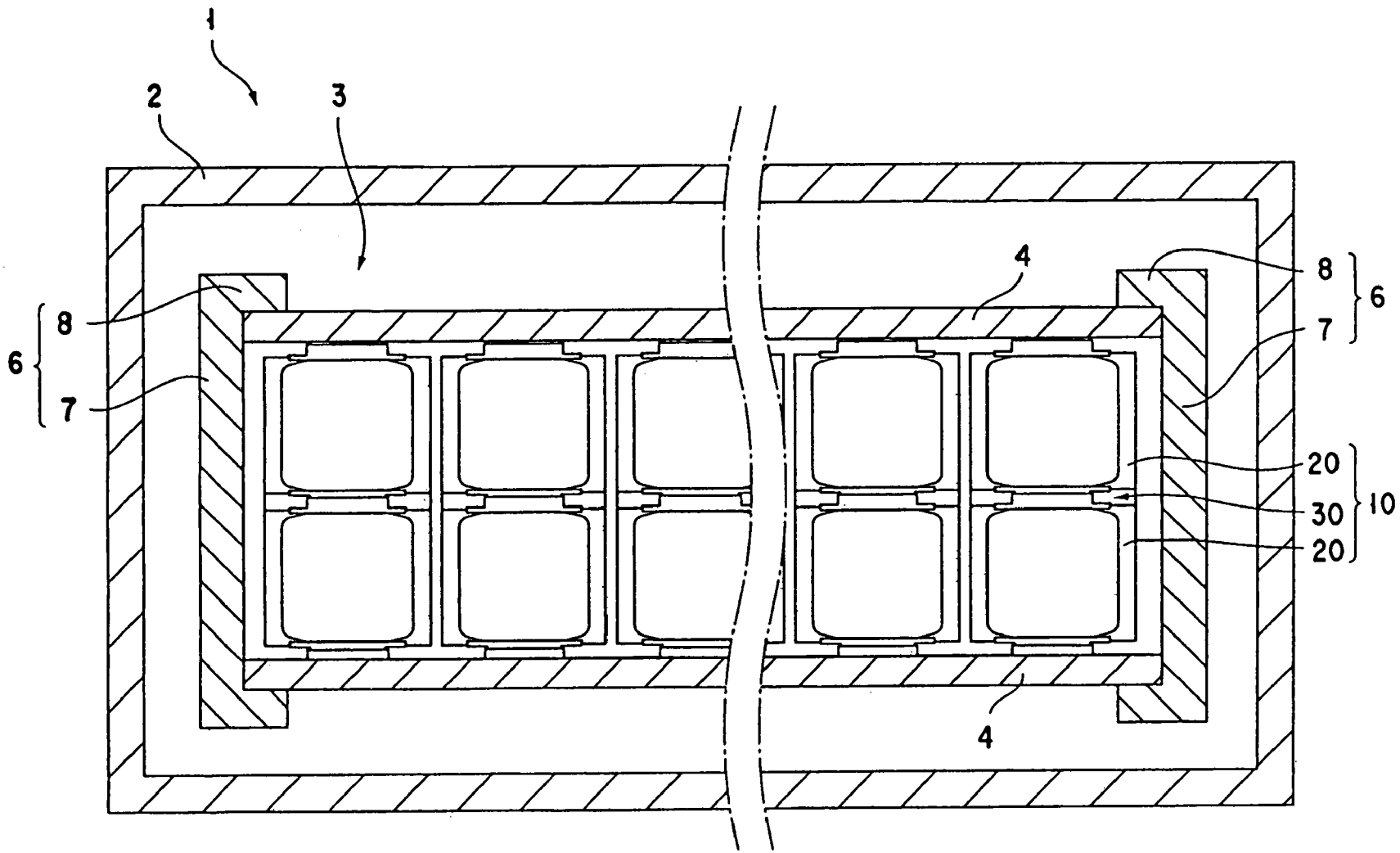
FIG. 1 is a fragmentary cross-sectional view schematically illustrating one embodiment of a storage apparatus of the present invention.

According to the inventors' study, it has been found that if the interaction area in snap-in-fitting of a male engaging part and a female engaging part is formed as an inclined engaging surfaces and adapted to apply load to the female engaging part so as to always urge the female engaging part outward, it is possible to establish close contact thereof without producing looseness, the electrical resistance becomes small, and thus a good electric connection may be established.

Here, though the embodiments of applying load for always straining the female engaging part outward include an embodiment in which the male engaging part presses the female engaging part, an embodiment in which the female engaging part presses the male engaging part, and an embodiment in which both the male engaging part and the female engaging part press other party, it can be understood that in either embodiment load is applied to the female engaging part so as to always urge the female engaging part outward.

The particularly good engaging state is the case in which the inclined engaging surface mentioned above is a tapered surface convergent toward the male connector member side. In this case, since the male engaging part will be in the state that it is always pressed toward the inside of the space formed by the male connector member and the female connector member, this engaging state cannot be out of place easily and this good engaging state may be always maintained.

Particularly the connector of the present invention can be advantageously used as a connector for storage cells which comprises a couple of a male connector member and a female connector member, both being made of an electrically-conductive material and having an attachment part for attaching to a terminal, respectively. Such a connector can also be used to electrically connect one terminal to another terminal to be electrically connected with this terminal, simultaneously with the fixation of the relative positions of the respective terminals mentioned above, by the one-touch snap operation.

In such a connector, the male connector member and the female connector member are attached to the terminal of a storage cell (or capacitor cell) and to another terminal to be electrically connected with this terminal, respectively. The male connector member and the female connector member attached to the respective terminals are engaged with each other by the snap operation of the male and female engaging means (the male engaging part and the female engaging part). Then, they are fixed to the state where the both terminals' positions are close to each other (or the state in which the both terminals are in contact with each other). Further, since the male connector member and the female connector member are formed from a conductive member, the engagement of the male connector member with the female connector member establishes the electrical conduction.

When the male connector member and the female connector member are disengaged by the snap operation, the electric connection is also canceled simultaneously with the separation of the terminals.

Since it is possible to detachably connect the terminals by the snap operation through the engagement/disengagement of the male connector member and the female connector member, the assembly work and the disassembly work are very simple. Since some hundreds of storage cells may have to be connected in a large-sized storage apparatus which is represented by an ultra capacitor, for example, the effect is very large.

Further, since the male connector member and the female connector member of the connector have electrical conductivity, if both are engaged with each other, the terminals are electrically connected. Therefore, electric wiring becomes unnecessary and the connection work becomes very simple.

It is also considered that the function of snap-in-fitting is given to the terminal itself of a storage cell. However, when the engaging means is damaged by the repeated snap operation, it will be necessary to exchange the whole terminal or, if only a terminal cannot be removed, to exchange the whole storage cell. In this respect, by attaching the connector as a separate member to the terminal, when the engaging means (the male engaging part and the female engaging part) is damaged, it is required merely to exchange only the male connector member or the female connector member. Accordingly, it is possible to considerably reduce the cost of replacement parts.

Although it is desirable that a conductive material for forming a male connector member and a female connector member should be metal exhibiting large electrical conductivity, such as tough pitch copper, it may be a conductive polymer or a conductive resin containing a conductor, such as copper, silver, and graphite, dispersed in a polymer material.

It is desirable that at least one of the male connector member and the female connector member should be integrally formed by forging. If it is formed by forging, the production efficiency will be high and consequently the production cost may be reduced.

Another terminal to be electrically connected to the terminal of a storage cell may be the terminal of another storage cell or the terminal attached to a connection member such as a bus plate. The contour and structure of both terminals may be identical with or different from each other.

According to the present invention, it is desirable that the above-mentioned terminal should have a screw part and at least one of the male connector member and the female connector member mentioned above should have a screw part to be screwed onto the screw part of the terminal mentioned above. According to such construction, it is possible to attach the male connector member or the female connector member to the terminal only by screwing the screw part of the connector (the male connector member or the female connector member) onto the screw part of the terminal. Accordingly, attachment of the connector to the terminal and detachment thereof can be done easily. Incidentally, a male screw part may be formed in either of the terminal and the male connector member (or the female connector member) and the female screw part may be formed in other one.

In a preferred connector of the present invention, the above-mentioned male connector member comprises a base part having an inner hole which allows a terminal to be inserted therein, a female screw part formed in the inner circumferential surface around the inner hole, and the male engaging part standing from the above-mentioned base part so as to surround the inner hole mentioned above, and the above-mentioned female connector member comprises a base part having an inner hole which allows a terminal to be inserted therein, a female screw part formed in the inner circumferential surface around the inner hole, and the female engaging part standing from the above-mentioned base part so as to surround the inner hole mentioned above. Such a connector may be advantageously used for the storage cell having male screw parts in the outer circumferential surfaces of its terminals.

According to such construction, the male connector member (or the female connector member) can be attached to a terminal by inserting a terminal into the inner hole of the base part and screwing the female screw part of the male connector member (or the female connector member) onto the male screw part of the terminal. Since the male engaging part (or the female engaging part) is standing from the base part so as to surround the inner hole, when the male connector member (or the female connector member) is attached to the terminal, the terminal is protected by the male engaging part (or the female engaging part) surrounding it. Accordingly, the attachment of a foreign substance to the terminal is prevented, and the break down of a storage cell or the like is prevented.

In a more preferred connector of the present invention, at least one of the male connector member and the female connector member mentioned above has an inner ring part standing from the inner circumferential edge around the inner hole of the base part mentioned above, the above-mentioned female screw part is formed in the inner circumferential surface of the inner ring part, and a groove portion in which the above-mentioned female screw part is not formed is provided in the inner circumferential surface of the inner ring part mentioned above. According to such construction, the male connector member (or the female connector member) can be attached to a terminal by screwing the female screw part of the inner ring part onto the male screw part of the terminal.

Although the female screw part of the inner ring part may be formed by threading, for example, it may be engraved by the rolling (pressing). By forming the female screw part of the inner ring part by the rolling, the production efficiency of a connector will increase and the production cost may be reduced.

The inner ring part mentioned above is desired to have a slit or a groove portion on which the above-mentioned female screw part is not engraved so that it may be elastically deformed easily.

It is desirable that at least one of the male connector member and the female connector member should have a knob part formed on the upper end of the above-mentioned inner ring part so as to extend from the groove portion mentioned above outward in the radial direction of the inner ring part mentioned above. According to such construction, since a finger or the like may be hooked on the knob part to turn the male connector member (or the female connector member), it is possible to screw the male connector member (or the female connector member) onto the male screw part of a terminal simply, and thus the working efficiency, such as an assembly, may be improved.

In a preferred connector of the present invention, the diameter of the inner circumferential surface of the above-mentioned inner ring part decreases from the above-mentioned base part toward the upper end thereof in such a manner that at lease the minimum diameter of the inner circumferential surface mentioned above may become smaller than the minimum diameter of the male screw part of the above-mentioned terminal. Incidentally, the above-mentioned inner ring part is desired to have the elasticity of such a degree that its diameter is enlarged by screwing onto the terminal.

In another preferred embodiment of the present invention, the base part of at least one of the male connector member and the female connector member mentioned above is desired to have a hole portion formed outside of the above-mentioned engaging means (the male engaging part, the female engaging part). According to such construction, since a finger or a tool may be inserted in the hole portion to turn the male connector member (or the female connector member) simply and quickly, the male connector member (the female connector member) may be screwed onto the male screw part of the terminal simply. In this case, it is desirable to form a plurality of nail-like engaging means (the male engaging parts or the female engaging parts) disposed annularly on the base part by raising the pieces formed by cutting therein along the configurations of a plurality of hole portions. In this case, since the formation of the hole portions and the nail-like engaging means (the male engaging parts or the female engaging parts) may be performed simultaneously, the hole portions may be formed without pushing up the production cost.

Further, it is desirable that the base part of at least one of the male connector member and the female connector member mentioned above should have a plurality of nail pieces projecting outward in the radial direction and formed in the outer edge of the base part. According to such construction, a finger or a tool may be hooked on the nail piece (or a concave portion or a gap between the nail pieces) to turn the male connector member (or the female connector member), and the male connector member (or the female connector member) may be screwed onto the male screw part of the terminal simply. In this case, it is desirable to form a plurality of nail pieces (and concave portions between the nail pieces) simultaneously with the formation of a plurality of nail-like engaging means (the male engaging parts or the female engaging parts) disposed annularly on the base part by raising the small pieces formed by cutting in the edge portion of the base part. Also in this case, the formation of the nail-like engaging means (the male engaging parts, the female engaging parts) and the formation of concave portions (the formation of the nail pieces which remains between concave portions) can be performed simultaneously, without pushing up the production cost.

In the use of the connector mentioned above, it is desirable to use a unit for covering the connected part between the terminals, which unit comprises a couple of male and female cover members each having a opening in the center of a base plate and a circumferential wall part of a predetermined height standing from the periphery thereof, respectively, wherein the circumferential wall part of the male cover member mentioned above is adapted to be guided into the circumferential wall part of the female cover member. The cover unit for the connected part between terminals according to the present invention is a washer-like cover unit for the connected part between the terminals to be electrically connected by snap-in-fitting and is adapted that the circumferential wall part of the male cover member mentioned above is guided into the circumferential wall part of the female cover member. Therefore, it has the following functions and effects.

(1) Guidance at the Time of Snap-in-Fitting

Since it is so constructed that the connection between terminals by means of the connector is done by the snap-in-fitting and the male and female cover members guide each other, the male cover member and the female cover member of cover unit function as the centering guide at the time of snap-in-fitting. As a result, the operation characteristics at the time of engagement is markedly improved and such problems as the deviation of the center positions of the male and female connector members and the damages of the engaging parts may be solved. Incidentally, as the structure in which the cover members guide each other, various embodiments such as, for example, an embodiment in which an edge part of the circumferential wall part of the male cover member and/or an edge part of the circumferential wall part of the female cover member is enlarged inward or outward or beveled and the perpendicular circumferential wall parts overlap in slidably contact with each other, preferably an embodiment in which the circumferential wall part of the male cover member fits in the circumferential wall part of the female cover member to effect the snap-in-fitting, may be employed.

The connector of the snap-in-fitting system is so designed as to have the increased disengaging force to prevent the detachment at the time of use. At the same time, engaging force is also increased. Therefore, when the center positions of the male connector member and the female connector member of the connector of the snap-in-fitting system are not aligned with each other at the time of engagement, there is a possibility of requiring great force for engagement or damaging an engaging part. By utilizing the male cover member and the female cover member of the cover unit of the present invention as a centering guide at the time of snap-in-fitting, such a problem may be solved. In this case, what is necessary is just to arrange the cover unit of the present invention outside the connector of the snap-in-fitting system and to adjust the height relation between the male and female connector members of the connector and the male and female cover members of the cover unit in such a manner that the male and female cover members of the cover unit come to contact with each other before the male and female connector members of the connector come to contact with each other. By properly designing the contours of the male and female cover members of the cover unit (for example, the diameters of these members are enlarged), it is possible to absorb the deviation of the center positions thereof. Further, if the thickness of each of the circumferential wall parts of the male and female cover members is so designed as to be increased toward the base end side rather than the upper opening end side, the centering will be done according to insertion of the male cover member into the female cover member.

(2) Dust Proofness and Drip Proofness

Further, since the closed space is formed by the male cover member and the female cover member of the cover unit when the male cover member is guided into the female cover member and the connected part between terminals by means of the connector lies in this space, the dust proofness and the drip proofness are greatly improved, and the attachment of dust and liquid to the connected part between terminals is prevented effectively.

As a material for the male cover member and the female cover member of the cover unit, although any material having the elasticity, such as plastics and metal, may be used, it is desirable to make it with a plastic material in view of the above-mentioned effects.

When the cover unit made of a plastic material is used, since both the male and female cover members are plastics, it is possible to improve the close contact therebetween. It is also possible to avoid producing looseness because of the superposition of the male and female cover members each other. Incidentally, when the cover unit made of a plastic material is used, there is a possibility of producing moisture condensation in the closed space due to the excellent sealing characteristics, which will be the cause of corrosion or the like of the connector. Accordingly, it is desirable to prepare a drainage hole in the base end side of the circumferential wall part, for example, in order to discharge the condensed droplets therein.

However, when it is used under the circumstances where the above-mentioned dust proofness and drip proofness are not required, the circumferential wall part of the male cover member and/or the female cover member does not need to be exist overall periphery. Accordingly, it is possible to form a slit, a cutout, etc. in the circumferential wall part of the male cover member and/or the female cover member to give them elasticity or to adjust the engaging force thereof. Even when slits or cutouts are formed therein, it is also possible to form the closed space by their positional relation in the circumferential direction and to adjust the degree of opening.

The storage module of the present invention comprises two or more storage cells, each having a pair of terminals for inputting and outputting electric power, for storing and discharging electric power through the terminals, and the above-mentioned connectors fixedly secured to the terminals mentioned above, wherein the storage cells mentioned above are adapted to be electrically connected to each other simultaneously with the fixation of the relative positions of the respective terminals mentioned above by the above-mentioned connector.

The storage module containing a plurality of storage cells connected in this way is suitable as a battery of a portable type electronic device, for example. As the portable type electronic device, a notebook type personal computer, a cellular phone, a PDA (Personal Digital Assistance), a portable type music media reproduction machine, for example, may be cited.

In the storage module of the present invention, it is desirable that the above-mentioned storage cells should have respective circumferential wall parts which define a connection space containing the above-mentioned terminals by surrounding the terminals at their side positions when two storage cells having respective terminals in opposed to each other come to close and the above-mentioned connector should lie in the closed connection space when the terminals mentioned above are electrically connected to each other by the above-mentioned connector. According to such construction, the terminals connected are protected by the circumferential wall parts. For instance, it is also possible to liquid-tightly define the connection space by the circumferential wall parts to protect the terminals securely. As a result, adhesion of a foreign substance to the terminal may be prevented, operation of the storage apparatus may be stabilized, and its reliability may be improved.

Incidentally, the circumferential wall parts may be provided in both storage cells to be connected to each other or either one of the storage cells.

In the storage module of the present invention, the above-mentioned cover unit for the connected part between terminals may also be used. In this case, the male cover member and the female cover member of this cover unit are attached to the respective terminals in the state of being nipped between either of the terminals of the storage cell mentioned above and either of the male connector member or the female connector member of the connector mentioned above.

The storage apparatus of the present invention is equipped with a plurality of storage modules mentioned above. According to an example of such construction, it is possible to assemble a large-sized storage apparatus (ultra capacitor) equipped with some hundreds of storage cells, which can be employed as a power source of an electric vehicle, for example. In this case, although some hundreds of storage cells must be connected, the assembly efficiency is markedly improved because they can be connected by the snap-in-fitting by means of the connector.

Incidentally, the storage apparatus may be assembled by electrically connecting a plurality of storage modules with a bus bar or a bus plate.

The connection structure of the storage cells of the present invention is suitably applicable to such a storage module, a bus bar, or a bus plate. Particularly, in the connection structure in which the male connector member and the female connector member are connected to each other by abutting respective end faces of the inner ring parts of the male connector member and the female connector member faced to the axial direction thereof to each other and pressing the outer circumferential surface of the outer ring part of the male connector member and the inner circumferential surface of the outer ring part of the female connector member against each other, since a current path is formed between the mutually abutted end faces of the inner ring parts of the male connector member and the female connector member and a further current path is formed between the outer circumferential surface of the outer ring part of the male connector member and the inner circumferential surface of the outer ring part of the female connector member, the male connector member and the female connector member have two current paths formed in the outer ring parts and the inner ring parts, respectively. Therefore, since the area in which an electric current flows may be enlarged, a large electric current may be passed therethrough.

Here, the outer ring parts of the male connector member and the female connector member may be formed as an elastically deformable member or an elastic member. In case the elastically deformable members are used, the outer circumferential surface of the outer ring part of the male connector member and the inner circumferential surface of the outer ring part of the female connector member may be caulked mutually. On the other hand, in case the elastic members are used, the outer circumferential surface of the outer ring part of the male connector member and the inner circumferential surface of the outer ring part of the female connector member may be elastically pressed mutually. The elastic member is preferred because it has higher durability than the elastically deformable member.

In the above-mentioned embodiment, various modes may be adopted to reduce the connection resistance between the male connector member and the female connector member. For example, the outer circumferential surface of the outer ring part of the male connector member may have an enlarged diameter portion of which diameter increases in the radial direction as being distance from the female connector member side. In this case, the enlarged diameter portion of the outer ring part of the male connector member and the inner circumferential surface of the outer ring part of the female connector member may be elastically pressed mutually in the state that the male connector member and the female connector member are connected. Further, the inner circumferential surface of the outer ring part of the female connector member may have a reduced diameter portion of which diameter decreases in the radial direction as being distance from the male connector member side. In this case, the outer circumferential surface of the outer ring part of the male connector member and the reduced diameter portion of the outer ring part of the female connector member may be elastically pressed mutually in the state that the male connector member and the female connector member are connected.

Various modes may be adopted to fixedly secure the male connector member and the female connector member mentioned above to a body of a storage cell. For example, screw parts may be formed in the inner circumferential surfaces of the inner ring parts of the male connector member and the female connector member, respectively, and a plurality of nail pieces projecting outward in the radial direction may be formed in the outer peripheral edges of the outer ring parts of the male connector member and the female connector member, respectively. In this case, the nail pieces may be utilized as an engaging portion of the predetermined tool to be used in the fastening of the screw parts. Accordingly, in case the male connector member or the female connector member is screwed and fixedly secured onto the terminal of a storage cell, the fixation can be performed easily.

The nail pieces may be formed in various embodiments. For example, the male connector member and the female connector member may have the different number of nail pieces so that they can be discriminated easily. Further, in at least one side of the terminals of the male connector member and the female connector member, the adjoining nail pieces may be connected by a connection part. In such an embodiment, the intensity of the nail piece may be improved by the connection part. In case the adjoining nail pieces of either one of the connector members is connected by the connection part, since the contours of the nail pieces are different between the male connector member and the female connector member, it is possible to easily discriminate the male connector member and the female connector member.

The nail pieces of the male connector member and the female connector member may be formed at regular intervals in the circumferential direction, and the number of the nail pieces of the male connector member and the female connector member may be several times the number of the tooth of a predetermined tool. In such an embodiment, a common tool may be used when the male connector member and the female connector member are screwed and fixedly secured onto the respective terminals.

In order to easily perform the engagement of the above-mentioned tool to the nail pieces, for example, the nail pieces of the male connector member and/or the female connector member may have a shape curved so as to be gradually raised in the radial direction and come close to the other party connector member. In such an embodiment, it is possible to enlarge the contact line or area of the tool engaging with the nail pieces of the male connector member and/or the female connector member.

Various modes may be employed to easily perform the voltage detection of a plurality of storage cells to which the male connector member and the female connector member are connected. For example, the storage cell may be provided with a washer comprising a disk-like base part, a circumferential wall part formed along the peripheral edge thereof, and a collar extending outward in the radial direction from the top end of this circumferential wall part. In this case, the washer may be interposed and fastened between at least one of the male connector member and the female connector member and the terminal of the storage cell. In such an embodiment, the voltage detection of a plurality of connected storage cells may be performed by interposing a conductor between the mutually opposed collars of the respective top ends of the circumferential wall parts of the washers.

The connector described above is also applicable to a bus bar which is used to connect a plurality of storage cells. The bus bar of the present invention comprises a bus bar plate and the above mentioned connector. The male connector member of the above-mentioned connector is fixedly secured to one end portion of the bus bar plate mentioned above, and the female connector member is fixedly secured to the other end portion of the bus bar plate. In this case, it is suitable that the male connector member and the female connector member should be fixedly secured to the bus bar plate by welding. The nail pieces mentioned above may be advantageously used as a welding area.

In the bus bar of the present invention, the female connector member of one storage cell may be connected to the male connector member in one end portion of the bus bar plate, and the female connector member of another storage cell may be connected to the male connector member in the other end portion of the bus bar plate.

As described above, when copper which exhibits a low ionization tendency is used as a base material of the connector which is brought into contact with the terminal made of aluminum which exhibits a high ionization tendency, there is a problem that the thickness of the aluminum terminal will decrease due to the electrolytic corrosion action.

Accordingly, it is desirable that a plating layer of metal, Ni, which exhibits the ionization tendency higher than a base material (copper) should be formed on the surface of the base material. Since the ionization tendency of Ni is higher than the base material (copper), it is possible to prevent the electrolytic corrosion of the aluminum terminal which is in contact therewith because the potential difference of nickel-aluminum is small as compared with that of copper-aluminum.

However, a Ni plating layer is hard and its electrical conductivity is comparatively poor. Therefore, it is difficult to compensate the surface roughness (undulation) of the connector member, the close contact between the male connector member and the female connector member will become poor at the time of snap-in-fitting thereof, and the contact resistance with a terminal will become high due to this problem together with the poor conductivity.

Such problems may be solved by compensating the badness of the electrical conductivity of the Ni plating layer by forming a Cu—Sn plating layer exhibiting good conductivity on the Ni plating layer. Further, since the Cu—Sn plating layer is comparatively soft and thus may compensate the surface roughness (undulation) of the connector member at the time of snap-in-fitting of the male connector member to the female connector member, the male connector member and the female connector member exhibit good close contact and good sliding characteristics at the time of snap-in-fitting thereof.

Since the Ni plating layer has poor conductivity as described above, it is necessary to make the plating thickness thereof thin. On the other hand, it is possible to form a thicker Cu—Sn plating layer only with difficulty, and the film thickness will be restricted in the usual plating processing.

Therefore, if it is required to increase the total film thickness of plating layers and to further improve the resistance to electrolytic corrosion, it is desirable that a Sn plating layer should be further formed on the Cu—Sn plating layer mentioned above. The Sn plating layer exhibits good conductivity, thus can compensate the poor conductivity of the Ni plating layer, and allows the formation of thick plating layer. Further, the Sn plating layer exhibits very high corrosion resistance and thus is suitable as a surface layer. Moreover, since the Sn plating layer is soft, it may compensate the surface roughness (undulation) of the connector member at the time of snap-in-fitting of the male connector member to the female connector member, and the close contact between the male connector member and the female connector member becomes good. However, since it is soft, the sliding characteristics at the time of snap-in-fitting tend to be impaired. Incidentally, although it will be difficult to form the Cu—Sn plating layer on the Sn plating layer, it is possible to form the Sn plating layer on the Cu—Sn plating layer. Further, when the Cu—Sn plating layer is omitted and two Sn plating layers are formed instead, the surface roughness becomes large and the male connector member and the female connector member may be snap-in-fitted only with difficulty.

In view of the characteristics or features required of each plating layer described above, the proper thickness of Ni plating layer is about 0.1-15 μm, the proper thickness of Cu—Sn plating layer is about 0.1-10 μm, and the proper thickness of Sn plating layer is about 0-25 μm.

The formation of each plating layer may be performed by any method heretofore known in the art, generally by a series of treatments of degreasing, rinsing, acid activation, plating, (discoloration prevention processing), rinsing (or rinsing in hot water), drying and the like.

In the formation of a Ni plating layer, Ni plating baths containing a sulfate such as nickel sulfate as a source of nickel ion, and a chloride such as nickel chloride and ammonium chloride, or further a boric acid or the like are used. As the concentration of sulfate, such as nickel sulfate, generally about 150-500 g/liter will be sufficient.

In the formation of a Cu—Sn plating layer or Sn plating layer, heretofore used cyan-stannic acid baths, cyan-pyrophosphoric acid baths, pyrophosphoric acid baths (refer to JP-A-2004-35980, JP-A-10-102278, and Japanese Patent No. 3455712), or the like may be used. As a source of copper ion, water-soluble copper salts such as, for example, copper sulfate, copper nitrate, copper carbonate, copper methane sulfonate, copper sulfamate, copper 2-hydroxyethane sulfonate, copper 2-hydroxypropane sulfonate, copper chloride, and copper pyrophosphate may be cited. As a source of tin ion, water-soluble stannates such as, for example, stannous pyrophosphate, stannous chloride, stannous sulfate, stannous acetate, stannous sulfamate, stannous gluconate, stannous tartrate, stannous oxide, sodium stannate, potassium stannate, stannous methane sulfonate, stannous 2-hydroxyethane sulfonate, stannous 2-hydroxypropane sulfonate, and stannous borofluoride may be cited. The proper amount of the water-soluble copper salt to be incorporated in the bath is in the range of about 0.05-40 g/liter as copper, and the proper amount of the water-soluble stannate to be incorporated in the bath is in the range of about 1-60 g/liter as tin.

The above-mentioned plating bath, when necessary, may further incorporate therein any suitably selected additives, such as brighteners like amine derivatives and aldehyde derivatives, surface-active agents, stress relaxation agents, conductive assistants, antioxidants, anti-foaming agents, and pH buffers, as usual.

Incidentally, when the connector of the present invention is connected to a terminal through the medium of a cover member or washer, it is desirable that a cover member or washer made of metal should also be subjected to the plating treatment according to the present invention except a cover member or washer made of a plastic material.

Hereinafter, the present invention will be more specifically described in detail with reference to the drawings in which various preferred embodiments of the present invention are illustrated.

First, a fundamental embodiment of a storage apparatus in which the connector of the present invention can be advantageously used will be described with reference to FIG. 1 and FIG. 2.

This storage apparatus is a kind of a large-sized capacitor composed of a plurality of electric double layer capacitor cells (storage cells) and is used as an ultra capacitor which is a storage power supply unit of an electric vehicle.

As generally shown in FIG. 1, the storage apparatus 1 is equipped with a box 2 which has receipt space inside and a storage block 3 which is accommodated in the box 2 and has large storage capacity.

The storage block 3 is equipped with capacitor cells (storage cells) 20 which are units constituting the storage block 3, bus plates 4 for electrically connecting a plurality of capacitor cells 20, binding plates 6 which bind the storage block 3 as one aggregate, and connectors (connectors for storage cells) 30 which connect the capacitor cells 20 with each other or the capacitor cells 20 to the bus plates 4.

Figure 2:
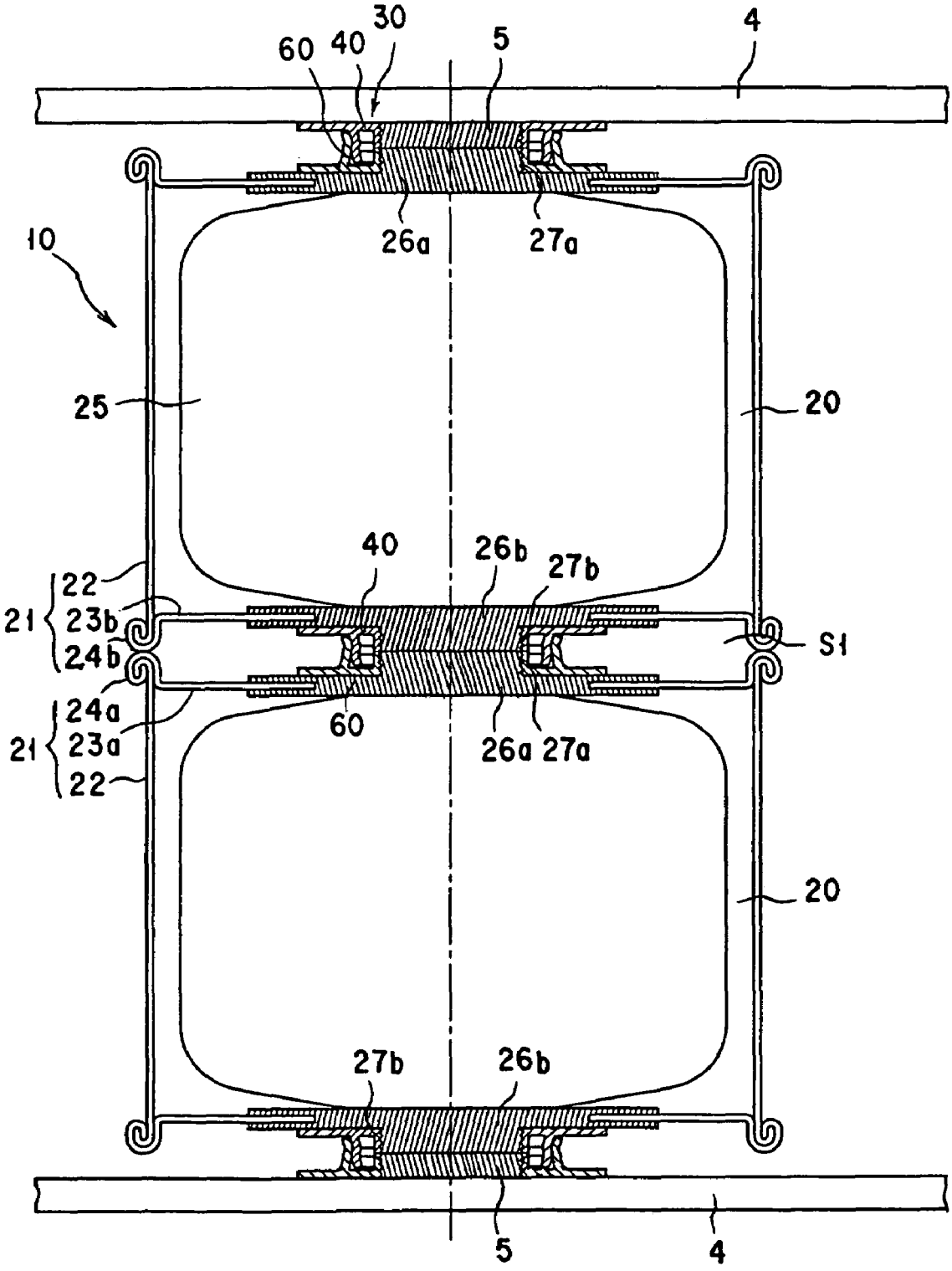
FIG. 2 is a fragmentary cross-sectional view schematically illustrating one embodiment of a storage module in the storage apparatus shown in FIG. 1.

The capacitor cell 20 is equipped with a case 21 which has receipt space inside, a battery part 25 accommodated in the case 21, and a pair of terminals 26*a* and 26*b* for inputting and outputting the electric power from the battery part 25, as shown in FIG. 2.

The case 21 is composed of a side board 22 which surrounds the circumference of the battery part 25 except for upper and lower ends, and lid plates 23*a* and 23*b* which close the openings of the upper and lower ends of the side board 22. Each opening edge of the side board 22 and the peripheral edge part of the lid plate 23*a* (or 23*b*) are bent outward one upon another and rolled up for sealing so that the inside of a case 21 is tightly sealed. The wall ends formed by bending at this time are raised from the lid plates 23*a* and 23*b* and serve as the circumferential wall parts 24*a* and 24*b* surrounding terminals 26*a* and 26*b*.

The battery part 25 is a capacitor, and an example which may be cited is an electric double layer capacitor cell, for example.

The terminals 26*a* and 26*b* are disposed in the upper part and the lower part of the case 21, respectively, so as to face to the outside of the case 21 from the battery part 25 accommodated in the case 21. The terminals 26*a* and 26*b* are disposed in substantially the center of the lid plates 23*a* and 23*b*, respectively, so as to be projected therefrom and provided with the male screw parts 27*a* and 27*b* formed in the outer circumferential surfaces. Incidentally, the height from each lid plate to the leading end of the terminal is substantially the same as the height from each lid plate to the end of the circumferential wall part.

Here, as shown in FIG. 2, the storage module 10 is composed of two capacitor cells 20 connected in series. At the state in which two capacitor cells 20 are connected, the ends of circumferential wall parts 24*a* and 24*b* abut against each other to produce the state where the terminals 26*a* and 26*b* are isolated from the outside by two sheets of lid plates 23*a* and 23*b* and the circumferential wall parts 24*a* and 24*b*. The connection space S1 is formed by these lid plates 23*a* and 23*b* and circumferential wall parts 24*a* and 24*b*, and the connected part lying in this space is protected from the outside. As shown in FIG. 1, the storage block 3 is composed of a great number of storage modules 10 connected in parallel.

The bus plate 4 is equipped with a plurality of terminals 5 arranged at predetermined pitches and is arranged in the upper and lower ends of the storage modules 10 arranged in parallel, respectively. The terminal 5 of the bus plate 4 and the terminal 26*a* or 26*b* of the storage module 10 (capacitor cell 20) is connected by the connector 30. The storage modules 10 arranged in parallel are electrically connected by the bus plate 4.

The binding plate 6 is equipped with a base plate 7 having substantially the same length as the stacked unit composed of a plurality of storage modules 10 clamped with the bus plates 4 and pinching pieces 8 protruded continuously from the both ends of this base plate 7, and the bus plates 4 in the state of clamping a plurality of storage modules 10 are nipped by the pinching pieces 8 from both sides and bundled.

The connectors 30 are arranged between two capacitor cells 20 which constitute the storage module 10 and also between the capacitor cell 20 and the bus plate 4, respectively. The connectors 30 detachably join the capacitor cells 20 each other and the capacitor cell 20 to the bus plate 4 and at the same time electrically connect them.

Next, the first fundamental embodiment of the connector (connector for storage cell) of the snap-in-fitting system of the present invention will be described with reference to FIG. 3 through FIG. 8.

Figure 3:
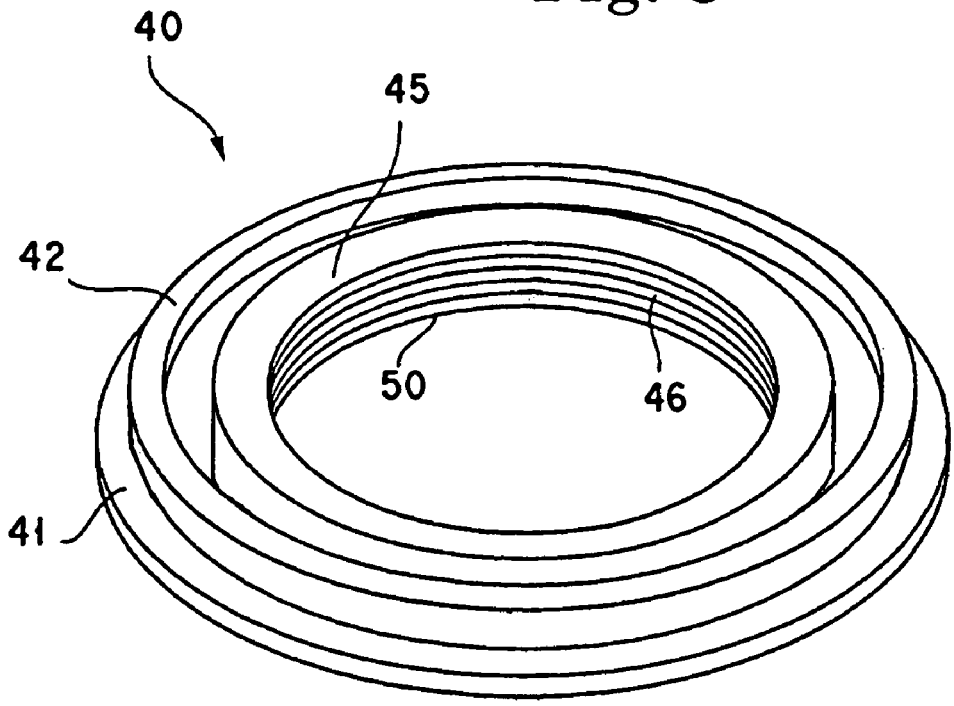
FIG. 3 is a perspective view illustrating the first embodiment of a male connector member of the connector of the snap-in-fitting system of the present invention used in the storage module shown in FIG. 2.
Figure 4:
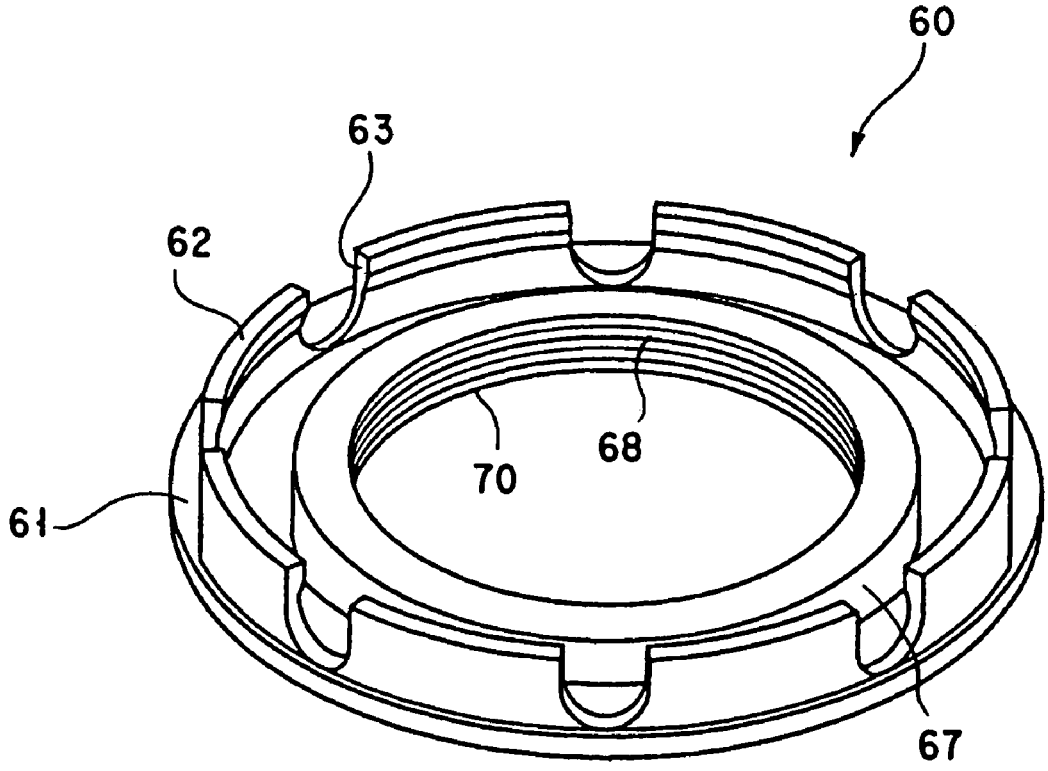
FIG. 4 is a perspective view illustrating the first embodiment of a female connector member of the connector of the snap-in-fitting system of the present invention used in the storage module shown in FIG. 2.

The connector 30 is composed of a male connector member 40 shown in FIG. 3 and a female connector member 60 shown in FIG. 4, which are joined or separated from each other by the snap operation.

Figure 5:
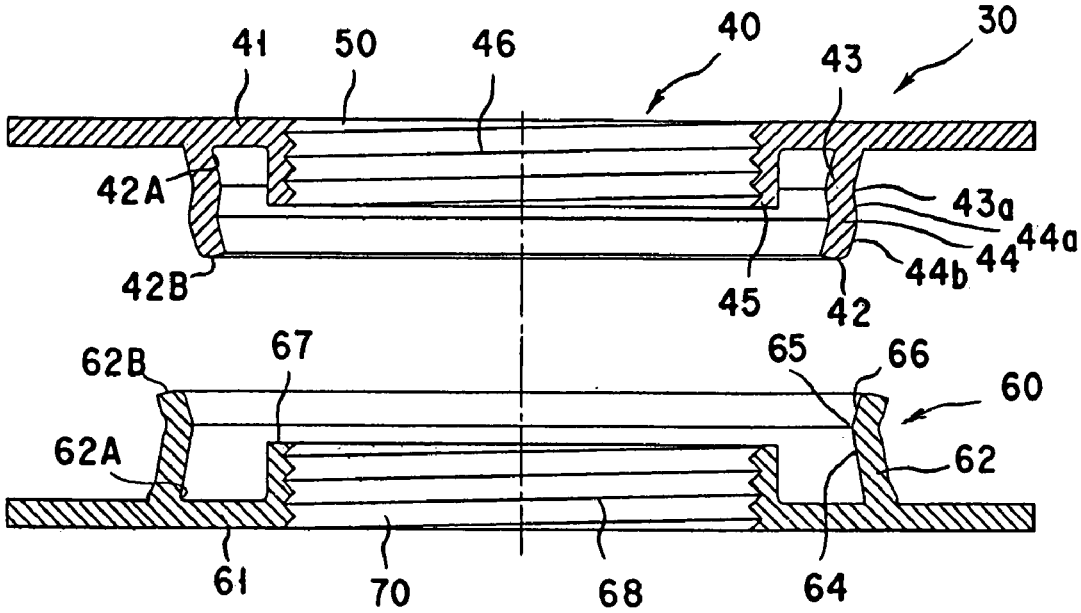
FIG. 5 is a cross-sectional view illustrating the male connector member and the female connector member of the connector shown in FIG. 3 and FIG. 4 as being arranged in the opposed state.

The male connector member 40 comprises, as shown in FIG. 3 and FIG. 5, a base part 41 of a substantially circular plate having an inner hole 50 in the center, an inner ring part 45 which functions as an attachment part to a terminal and is raised from the inner circumferential edge around the inner hole 50, and an outer ring part (male engaging part) 42 standing from the base part 41 at a position near to the outside thereof so as to surround the inner ring part 45.

The inner ring part 45 is standing on the same side as the outer ring part 42, and a female screw part 46 is formed in its inner circumferential surface.

The outer ring part 42 is standing around the inner ring part 45 at a predetermined distance therefrom. The outer ring part 42 has a contour of substantially letter "S" curved from the base end side 42A to the upper opening end side 42B, as shown in FIG. 5.

Although the outside surface of the outer ring part 42 has the diameter gradually decreasing inward from the base end side 42A toward the opening end side 42B, it reaches a reduced diameter portion 43 of the minimum diameter in a substantially middle portion, and a male side engaging concave portion 43*a* is formed in this position. The diameter of the outer ring part begins to increase after this reduced diameter portion 43 to form the outside tapered surface 44*a* and reaches an enlarged diameter portion 44, and then decreases toward the opening end side 42B to form a tapered surface which is the male side guiding surface 44*b* so that the insertion into a female connector member may become easy.

The outer ring part 42 has elasticity. When the pressing force is added to the outer ring part 42 from its outside toward its inside, the diameter of the opening end side 42B will decrease slightly in the radial direction, and if the pressing force is removed, it will restore to the original diameter owing to the elastic restoring force.

On the other hand, the female connector member 60 comprises, as shown in FIG. 4 and FIG. 5, a base part 61 of a substantially circular plate having an inner hole 70 in the center, an inner ring part 67 which functions as an attachment part to a terminal and is raised from the inner circumferential edge around the inner hole 70, and an outer ring part (male engaging part) 62 standing from the base part 61 at a position near to the outside thereof so as to surround the inner ring part 67.

The inner ring part 67 is standing on the same side as the outer ring part 62, and a female screw part 68 is formed in its inner circumferential surface.

The outer ring part 62 is standing around the inner ring part 67 at a predetermined distance therefrom. The outer ring part 62 has a curved ring-like contour of which diameter gradually decreases from the base end side 62A and slightly increases from a position near the upper opening end side 62B, as shown in FIG. 5. Although the diameter of the inner circumferential surface of the outer ring part 62 gradually decreases from the base end side 62A toward the opening end side 62B, it begins to increase on the way.

In the inner circumferential surface of the outer ring part 62, the tapered surface (fitting concave portion) 64 is formed in the portion whose diameter is decreased, and the female side guiding surface 66 is formed by the tapered surface whose diameter is increased toward the opening end side 62B. Further, a female side engaging protruded part 65 is formed by the inner surface of a position of which diameter decreasing from the base end side 62A is changed to increase.

The outer ring part 62 is divided into eight by eight cutouts 63 formed at regular pitches, as shown in FIG. 4. The outer ring part 62 has elasticity. When the pressing force is added to the outer ring part 62 from its inside toward its outside, the diameter of the opening end side 62B will decrease slightly in the radial direction, and if the pressing force is removed, it will restore to the original diameter owing to the elastic restoring force. Incidentally, the outer ring part 62 may be elastically deformed easily by forming cutouts 63.

The inner diameter of the outer ring part 62 of the female connector member 60 in the opening side 62B is substantially identical with or slightly larger than the outer diameter of male side engaging concave portion 43*a* of the male connector member 40 so that the opening end side 62B of the outer ring part 62 of the female connector member 60 functions as a guide portion for the insertion of the female connector member to effect smooth insertion and engagement thereof. The inner diameter of the female side engaging protruded part 65 of the female connector member 60 is slightly smaller than the outer diameter of the male side engaging concave portion 43*a* of the male connector member 40. Further, the inner diameter of the fitting concave portion (64) formed by the inner surface of the female connector member 60 on the base end side is substantially identical with or slightly larger than the outer diameter of the male side engaging concave portion 43*a* of the male connector member 40.

Here, the male connector member 40 and the female connector member 60 are formed of a conductive metal ring as a whole, for example, made of tough pitch copper. These male connector member 40 and female connector member 60, inclusive of the female screw parts 46 and 68, may be easily formed by forging or pressing.

Next, the attachment of the male connector member 40 and the female connector member 60 as constructed above to the terminals will be described.

Figure 7:
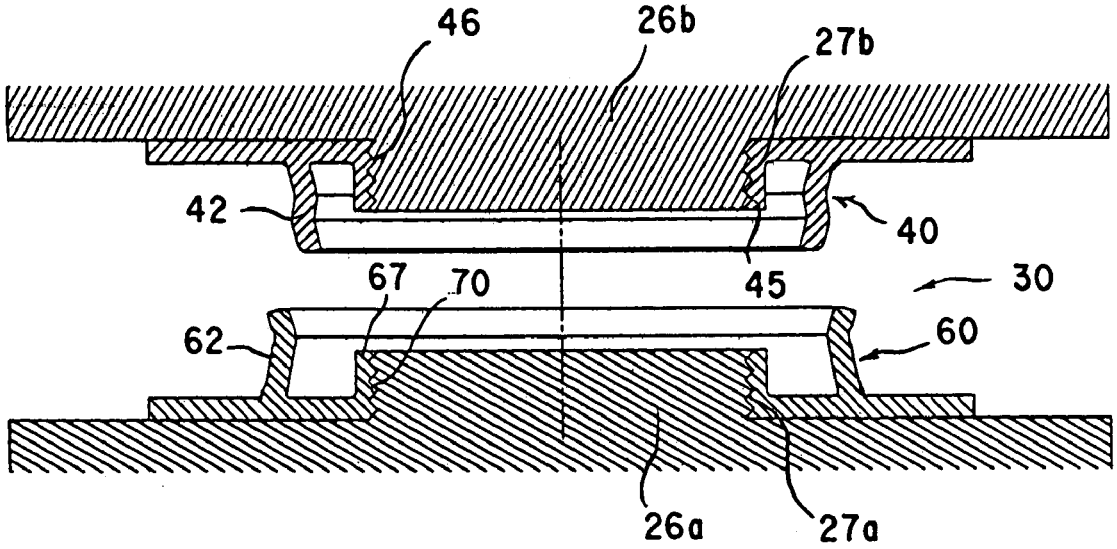
FIG. 7 is a cross-sectional view illustrating the male connector member and the female connector member of the connector shown in FIG. 3 and FIG. 4, both members being attached to the respective terminals, as being arranged in the opposed state.

Since the male connector member 40 and the female connector member 60 have the female screw parts 46 and 68 formed in the inner circumferential surfaces of the respective inner ring parts 45 and 67, when the male screw parts 27*b* and 27*a* are already formed in the terminals 26*b* and 26*a*, the female screw parts 46 and 68 formed in the inner ring parts 45 and 67 of the connector 30 (male connector member 40, female connector member 60) are screwed onto the male screw parts 27*b* and 27*a* of the terminals 26*b* and 26*a*, as shown in FIG. 7.

Figure 8:
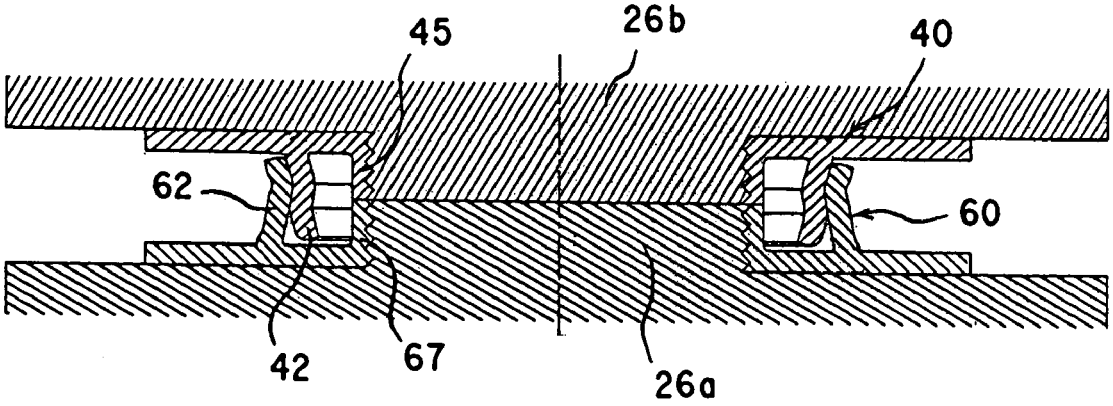
FIG. 8 is a cross-sectional view illustrating the snap-in-fitted state of the male connector member and the female connector member of the connector shown in FIG. 7, both members being attached to the respective terminals.

Thereafter, when the male connector member 40 and the female connector member 60 of the connector 30 fitted in each other by the snap operation as shown in FIG. 8, two terminals 26*b* and 26*a* are connected electrically because these members are made of a conductive material (for example, tough pitch copper).

Further, since the inner ring parts 45 and 67 and the terminals 26*b* and 26*a* are fastened with the screw parts, a contact surface becomes large by the undulation of a screw thread as compared with the case where the contact is effected only in the flat end faces of the terminals. Since the contact surface is larger, the electrical resistance becomes small to that extent and the electric connection becomes good. Further, since the electrical resistance becomes small, such a problem as generation of heat will not arise.

Next, the operation of the attachment and detachment of the male connector member 40 and the female connector member 60 by the snap operation will be described.

As shown in FIG. 7, in the state that the male connector member 40 and the female connector member 60 are arranged as opposed so that the respective outer ring parts 42 and 62 face each other, one member is pushed to the other member. Then, the outer ring part 42 of the male connector member 40 is fitted in the outer ring part 62 of the female connector member 60 while the female side guiding surface 66 is guiding the male side guiding surface 44*b*. When further pushed strongly, the female side engaging protruded part 65 is widened out by the tapered surface of the male side guiding surface 44*b*, the male side engaging concave portion 43*a* gets over the female side engaging protruded part 65 to effect the snap operation, and the female side engaging protruded part 65 will be fitted in the male side engaging concave portion 43*a*, as shown in FIG. 8. In this state, when the outer ring part 62 of the female connector member 60 restores to the direction that its diameter decreases, the male side engaging concave portion 43*a* of the male connector member 40 is restrained by the female side engaging protruded part 65 of the female connector member 60, thereby assuming such a state that the male connector member 40 and the female connector member 60 are engaged with each other.

Further, in the mutually engaged state shown in FIG. 8, when the male connector member 40 and the female connector member 60 are pulled in the direction that both members are separated, the male connector member is detached from the female connector member by snap operation as shown to FIG. 7, and they will assume the disengaged states.

Figure 6:
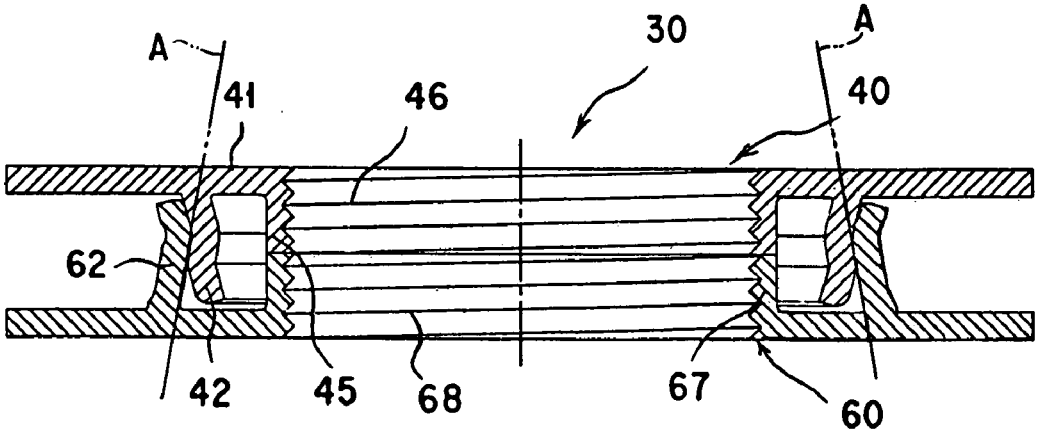
FIG. 6 is a cross-sectional view illustrating the snap-in-fitted state of the male connector member and the female connector member of the connector shown in FIG. 5.

As shown in FIG. 6, although the female side engaging protruded part 65 of the female connector member 60 is restrained by the male side engaging concave portion 43*a* of the male connector member 40, thereby assuming such a state that the male connector member 40 and the female connector member 60 are engaged with each other, the outer ring part 42 of the male connector member 40 is going to return to its original state by extending outward and the outer ring part 62 of the female connector member 60 received the action of this force is going to return to its original state by shrinking inward. The surfaces on which such force acts are the outer tapered surface 44*a* of the outer ring part 42 and the inner tapered surface 64 of the outer ring part 62 being in contact therewith, and these surfaces constitutes the engagement surface "A". As shown in FIG. 6, this engagement surface "A" is inclined and is a tapered surface convergent toward the male connector member 40. In this case, since the outer ring part 42 assumes the state that it is always pressed toward the inside of the space formed by the male connector member 40 and the female connector member 60, this engaging state cannot be released easily and this good engaging state may be always maintained. The more the angle of inclination of the engagement surface "A" is large, the more the engaging state is hardly released. Further, since the engaging area is large, the area through which the electric current flows becomes so large. Consequently, it is possible to establish close contact of both members without producing looseness, the electrical resistance becomes small and thus a good electric connection may be established.

It is needless to say that the connector of the present invention is not limited to the above-mentioned embodiment and may be modified through a wide range without departing from the principles of the present invention.

For instance, although in the above-mentioned embodiment the male connector member 40 and the female connector member 60 are provided with the respective female screw parts 46 and 68 in the inner circumferential surfaces of the respective inner ring parts 45 and 67 so that they may be screwed onto a screw terminal, the base part may be formed to an arbitrary shape according to an object for application, and any arbitrary joining means, such as welding and caulking, may be adopted.

Next, the storage module using the connector of the present invention described above will be explained. As shown in FIG. 2, the connector 30 is disposed between two capacitor cells 20, 20 constituting the storage module 10 to connect them. The male connector member 40 is attached to one of the opposed capacitor cells 20 which constitute the storage module 10, and the female connector member 60 is attached to the other one. Specifically, the male connector member 40 is screwed onto the lower terminal 26*b* of one capacitor cell 20, and the female connector member 60 is screwed onto the upper terminal 26*a* of the other capacitor cell 20.

Further, the connector 30 is also disposed between the capacitor cell 20 and the bus plate 4 to connect them. In this case, the male connector member 40 is screwed onto the terminal of either one of capacitor cell 20 and the bus plate 4, and the female connector member 60 is screwed onto the terminal of the other one. In the embodiment shown in FIG. 2, the male connector member 40 is attached to the lower terminal 26*b* of the capacitor cell 20, and the female connector member 60 is attached to the upper terminal 26*a* thereof. And the male connector member 40 is attached to the terminal 5 of one (upper) bus plate 4, and the female connector member 60 is attached to the terminal 5 of the other (lower) bus plate 4.

Next, the assembly of the storage apparatus 1 will be described.

First, a plurality of capacitor cells 20 are prepared, and connectors 30 are attached to the terminals 26*a* and 26*b* of the capacitor cells 20, respectively. At this time, since the male screw parts 27*a* and 27*b* are formed in the terminals 26*a* and 26*b* of each capacitor cell 20, the female screw parts 46 and 68 formed in the inner ring parts 45 and 67 of the connector 30 (male connector member 40 and female connector member 60) are screwed onto the male screw parts 27*b* and 27*a* of the terminals 26*b* and 26*a*, respectively.

Further, two bus plates 4 are prepared and the connector 30 (male connector member 40, female connector member 60) is attached to the terminal 5 of the bus plate 4.

Two capacitor cells 20 are connected through the medium of the connection of the male connector member 40 of the connector 30 with the female connector member 60 thereof to constitute the storage module 10. At this time, the male connector member 40 of the connector 30 and the female connector member 60 thereof are attached to each other by the snap operation. Since the connector 30 is made of a conductive material (for example, tough pitch copper), the capacitor cells 20 are electrically connected to each other at the same the male connector member 40 and the female connector member 60 are connected to each other by fitting.

A great number of storage modules 10 are arranged in parallel and clamped with the bus plate 4 at upper and lower ends. At this time, the male connector member 40 of the connector 30 and the female connector a member 60 thereof are attached to each other by the snap operation. And the bus plates 4 in the state of pinching the storage modules 10 therebetween are fastened with the binding plate 6 to assemble the storage block 3. This storage block 3 is placed in the box 2 to assemble the storage apparatus 1.

MODIFICATION EXAMPLE 1

Next, Modification Example 1 of the connector of the present invention will be described with reference to FIG. 9.

Although the fundamental structure of Modification Example 1 is the same as that of the connector 30 described as the first embodiment, the characteristic feature of this Modification Example 1 resides in the female screw part formed in an inner ring part. Incidentally, although a male connector member will be described as an example, the following description will also be applicable to a female connector member.

Figure 9:
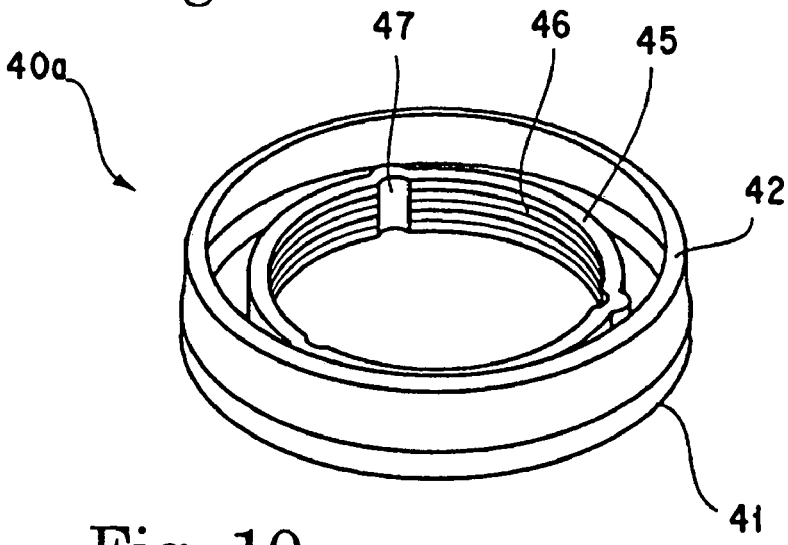
FIG. 9 is a perspective view illustrating the male connector member of Modification Example 1 of the connector of the present invention.

The male connector member 40*a* of the connector 30 shown in FIG. 9 comprises the base part 41, the outer ring part 42, and the inner ring part 45.

The female screw part 46 is formed in the inner circumferential surface of the inner ring part 45. Further, groove portions 47 are formed in the inner circumferential surface of the inner ring part 45 in the axial direction of the inner ring part 45 (in the direction of the cylindrical axis). The groove portions 47 are formed at predetermined pitches. For example, three groove portions are arranged with separation, angle 120 degrees. Incidentally, a female screw part is not formed in these groove portions 47. That is, the female screw part 46 is divided by the groove portions 47.

Then, a method for manufacturing such male connector member 40*a* of the connector 30 will be briefly described.

First, an annular member which comprises the base 41 having the inner hole 50, the outer ring part 42, and the inner ring part 45 is formed by forging or pressing. Further, groove portions 47 are engraved on the inner circumferential surface of the inner ring part 45 at predetermined pitches. Then, the female screw part 46 is formed in the inner circumferential surface of the inner ring part 45 by rolling. Incidentally, the contour of the male screw part used for the rolling is not transferred onto the areas of groove portions 47.

According to Modification Example 1 as described above, the male connector member 40*a* having the female screw part 46 formed by the rolling can be obtained. Therefore, the production efficiency is improved and the production cost is reduced.

MODIFICATION EXAMPLE 2

Next, Modification Example 2 of the connector of the present invention will be described with reference to FIG. 10.

Although the fundamental structure of Modification Example 2 is the same as that of Modification Example 1, the characteristic feature of this Modification Example 2 resides in that it is equipped with a knob part. Incidentally, although a male connector member will be described as an example, the following description will also be applicable to a female connector member.

Figure 10:
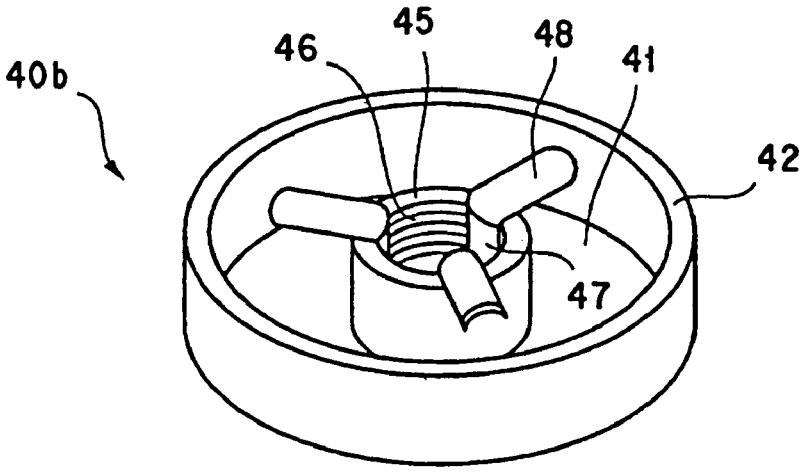
FIG. 10 is a perspective view illustrating the male connector member of Modification Example 2 of the connector of the present invention.

The male connector member 40*b* of the connector 30 shown in FIG. 10 comprises the base part 41, the outer ring part 42, and the inner ring part 45, and the female screw part 46 and the groove portions 47 are formed in the inner circumferential surface of the inner ring part 45 by the rolling.

In FIG. 10, the inner ring part 45 is provided at its upper end with knob parts 48 extending in the radial direction. The knob parts 48 continue from the groove portion 47 and are arranged with separation, angle 120 degrees.

Then, a method of forming the knob parts 48 will be described. In forming the groove portion 47 in the inner circumferential surface of the inner ring part 45, the inner circumferential surface of the inner ring part 45 is cut from the base part 41 side to the leading end of the inner ring part 45. At this time, the tongue-like pieces formed during the cutting of groove portions 47 are not cut off at the leading end of the inner ring part 45 and bent from the inner side of the inner ring part 45 toward the outside. Then, the knob parts 48 are formed of the bent tongue-like pieces.

According to such Modification Example 2 as described above, the following effects may be obtained.

(1) Since the knob parts 48 are formed in the male connector member 40*b*, when the male connector member 40*b* is screwed onto the terminal 26 of the capacitor cell 20, a finger or the like may be hooked on this knob part 48 to turn the male connector member 40*b*. Accordingly, it is possible to easily and quickly attach the male connector member 40*b* to the terminal 26.

(2) The knob parts 48 are formed by using the part cut at the time of the formation of the female screw part 46 by the rolling. That is, since a knob separately formed in advance is not attached to the male connector member, the knob parts 48 can be formed without pushing up the production cost.

MODIFICATION EXAMPLE 3

Next, Modification Example 3 of the connector of the present invention will be described with reference to FIG. 11.

Although the fundamental structure of Modification Example 3 is the same as that of Modification Example 1, the characteristic feature of Modification Example 3 resides in the point that slits are formed in the inner ring part. Incidentally, although a male connector member will be described as an example, the following description will also be applicable to a female connector member.

Figure 11:
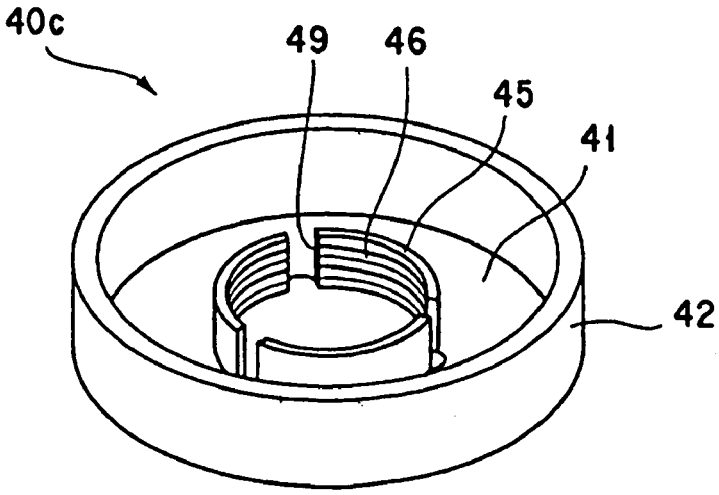
FIG. 11 is a perspective view illustrating the male connector member of Modification Example 3 of the connector of the present invention.

The male connector member 40*c* shown in FIG. 11 comprises the base part 41, the outer ring part 42, and the inner ring part 45, and the female screw part 46 is formed in the inner circumferential surface of the inner ring part 45 by the rolling.

In FIG. 11 the inner ring part 45 has slits 49 formed at predetermined pitches. The slits 49 are formed by cutting the inner ring part 45 from its base end to its leading end, and the base part 41 is also cut out slightly in the base end of the inner ring part 45.

The slits 49 are formed in the same positions as the groove portions 47 of Modification Example 1.

According to Modification Example 3 as described above, it is possible to form the inner ring part 45 in which the female screw part are engraved in the inner circumferential surface thereof and which is easily elastically deformable. Therefore, the female screw part 46 of the inner ring part 45 may be easily screwed onto the male screw part 27 of the terminal 26, and the conducting characteristics may be improved because the inner ring part 45 is pressed and strongly in contact with the male screw part 27.

MODIFICATION EXAMPLE 4

Next, Modification Example 4 of the connector of the present invention will be described with reference to FIG. 12A-FIG. 12C and FIG. 13. Although the fundamental structure of Modification Example 4 is the same as that of Modification Example 3, the characteristic feature of Modification Example 4 resides in that the inner ring part 45 is formed in a substantially truncated cone shape of which tapered diameter reduces gradually toward an upper end. Incidentally, although a male connector member will be described as an example, the following description will also be applicable to a female connector member.

Figure 12A:
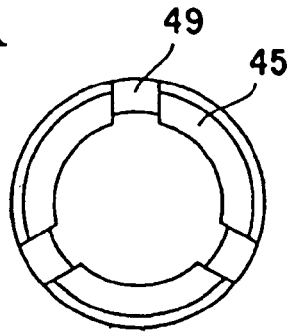
FIG. 12A through FIG. 12C illustrate Modification Example 4 of the connector of the present invention, FIG. 12A being a plan view of the inner ring part of the male connector member viewed from above, FIG. 12B being a fragmentary cross-sectional view thereof, and FIG. 12C being a cross-sectional view of a terminal of a storage cell.
Figure 12B:
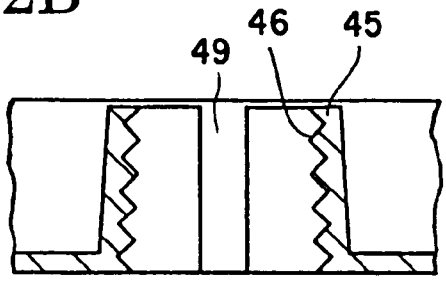
Figure 12C:
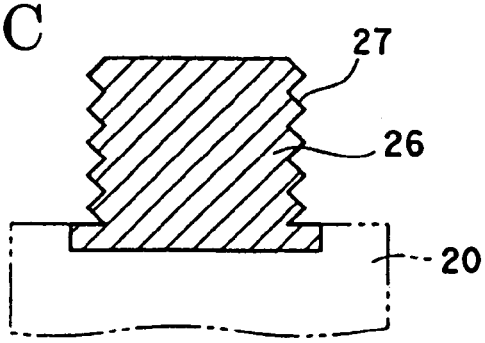

In the male connector member 40*c* of the connector 30 shown in FIG. 12A-FIG. 12C, the inner ring part 45 has the female screw part 46 and the slits 49.

In FIG. 12A-FIG. 12C, the inner ring part 45 has the tapered diameter reducing from the base end toward the upper end and is formed in the truncated cone shape. Incidentally, in the illustrated embodiment, although the outside surface as well as the inner circumferential surface have the tapered diameters reducing toward the upper end, at least the inner circumferential surface in which the female screw part 46 is formed should have the diameter reducing toward the upper end. The minimum diameter in the upper end of the inner ring part 45 is slightly smaller than the diameter of the terminal 26.

Figure 13:
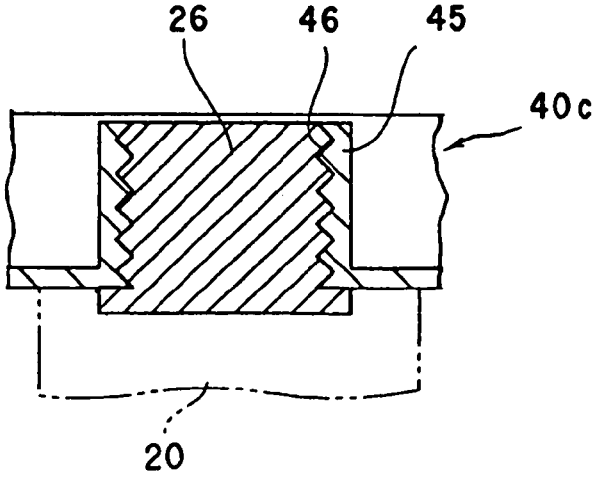
FIG. 13 is a fragmentary cross-sectional view illustrating the state of the male connector member of the connector screwed onto the terminal, in Modification Example 4 of the connector shown in FIG. 12A through FIG. 12C.

The male connector member 40*c* having such structure is screwed onto the terminal 26*b*, as shown in FIG. 13. Then, the diameter of the inner ring part 45 is expanded by the terminal 26. At this time, the female screw part 46 of the inner ring part 45 is screwed onto the male screw part 27 of a terminal 26 closely, and the mutual contact surface becomes large.

According to such Modification Example 4, since the inner ring part 45 has the diameter reducing toward an upper end, when it is screwed onto the terminal 26, the inner circumferential surface of the inner ring part 45 receives the force from the outside surface of the terminal 26 and its diameter is expanded elastically. At this time, the inner circumferential surface of the inner ring part 45 will be in the state where it is brought into strong contact with the outside surface of the terminal 26. Therefore, since the contact surface of the inner ring part 45 and terminal 26 becomes large, electric current becomes easy to flow to the connector 30 from the terminal 26 of the capacitor cell 20, and resistance may be reduced. Consequently, the quantity of electricity between the capacitor cells 20 connected by the connector 30 increases, and further it will not pose such a problem as generation of heat.

MODIFICATION EXAMPLE 5

Next, Modification Examples 5 and 6 of the connector of the present invention will be described with reference to FIG. 14 and FIG. 15.

Although the fundamental structure of Modification Example 5 is the same as that of the connector 30 described as the first embodiment, the characteristic feature of Modification Example 5 resides in the points that the cutouts are formed in the outer ring part 42 and the hole portions are formed in the outside of the outer ring part 42. Incidentally, although a male connector member will be described as an example, the following description will also be applicable to a female connector member.

Figure 14:
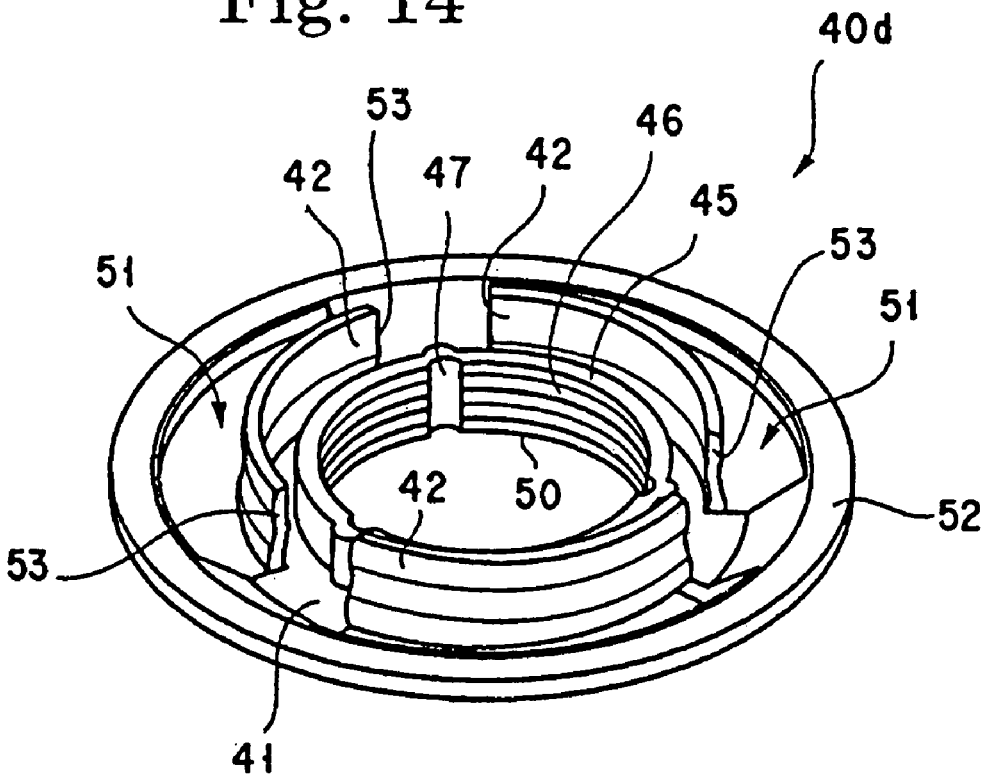
FIG. 14 is a perspective view illustrating the male connector member of Modification Example 5 of the connector of the present invention.

The male connector member 40*d* shown in FIG. 14 comprises the base part 41, the outer ring part 42, and the inner ring part 45.

Here, the base part 41 has a shape containing a flange part 52 extending around the outer ring part 42. The flange part 52 has operation holes (hole portions) 51 of a fixed length bored in the circumferential direction.

In the boring of the operation holes 51, the base part 41 is cut in the flange part 52 while leaving the neighborhood near the inner ring part 45 and the small pieces formed by this cutting is raised in the direction of the inner ring part 45 to form the outer ring part 42.

In FIG. 14, three operation holes 51 are formed, and thus the outer ring part 42 is divided by three cutouts 53.

MODIFICATION EXAMPLE 6

In the above-mentioned Modification Example 5, the size and number of the operation holes 51 and the size and number of the cutouts 53 of the outer ring parts 42 are not limited to the particular ones. For example, as in the case of Modification Example 6 shown in FIG. 15, the operation hole may be small and the number of cutouts 73 of the outer ring part 62 may be large.

Figure 15:
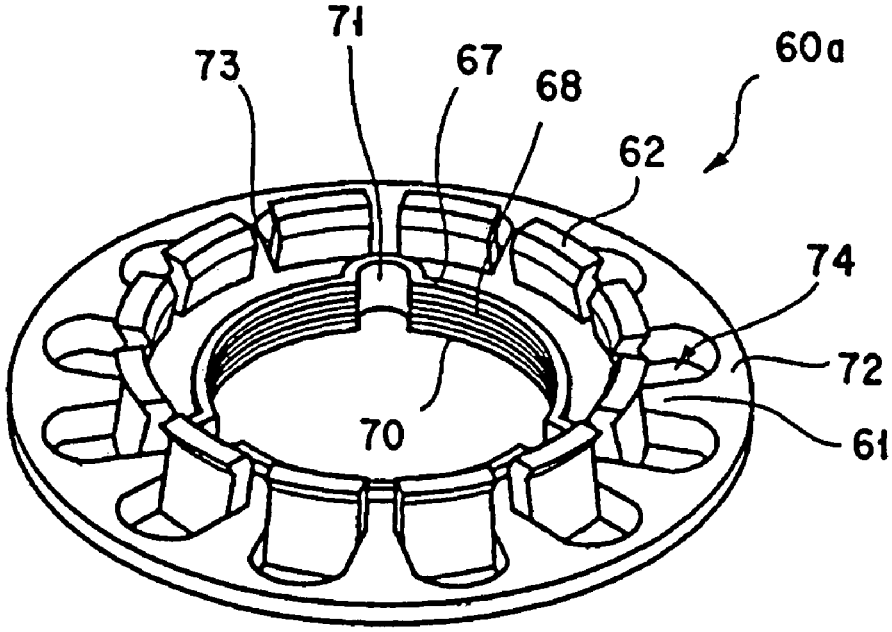
FIG. 15 is a perspective view illustrating the female connector member of Modification Example 6 of the connector of the present invention.

Although Modification Example 6 shown in FIG. 15 illustrates a female connector member, it is also applicable to a male connector member. The female connector member 60*a* of the connector shown in FIG. 15 comprises the base part 61, the outer ring part 62, and the inner ring part 67. The female screw part 68 is formed in the inner circumferential surface of the inner ring part 67, and three groove portions 71 are formed in the inner circumferential surface of the inner ring part 67 in the axial direction thereof (in the direction of the cylindrical axis) at predetermined pitches, for example, arranged with separation, angle 120 degrees. Here, the base part 61 has a shape containing the flange part 72 extending around the outer ring part 62. In this case, the outer ring part 62 is composed of a large number of nail-like parts formed by cutting and raising the base part 61 at predetermined intervals, thereby leaving the hole portions 74 in the parts of the large number of raised nail-like portions.

According to such Modification Examples 5 and 6, the following effects may be obtained.

(1) since the operation holes 51, 74 are formed around the outer ring parts 42, 62, a finger or a tool may be inserted into the operation hole to turn the male connector member 40*d* or the female connector member 60*a*. Accordingly, it is possible to easily and quickly attach the male connector member 40*d* or the female connector member 60*a* to the terminal 26.

(2) Since the formation of the operation holes 51, 74 may be performed simultaneously with formation of the outer ring parts 42, 62, the processing steps will not increase, and thus the operation holes may be formed without pushing up the production cost.

(3) The insertion load and the extraction load between the male and female connector members may be adjusted severally by the form of the individual nail-like parts of the outer ring part.

MODIFICATION EXAMPLE 7

Next, Modification Examples 7 and 8 of the connector of the present invention will be described with reference to FIG. 16 and FIG. 17.

Although the fundamental structure of Modification Example 7 is the same as that of the connector 30 described as the first embodiment, the characteristic feature of Modification Example 7 resides in the points that the cutouts are formed in the outer ring part 42 and concave portions 55 are formed in the rim portion of the base part 41 on the outside of the outer ring part 42. Incidentally, although a male connector member will be described as an example, the following description will also be applicable to a female connector member.

Figure 16:
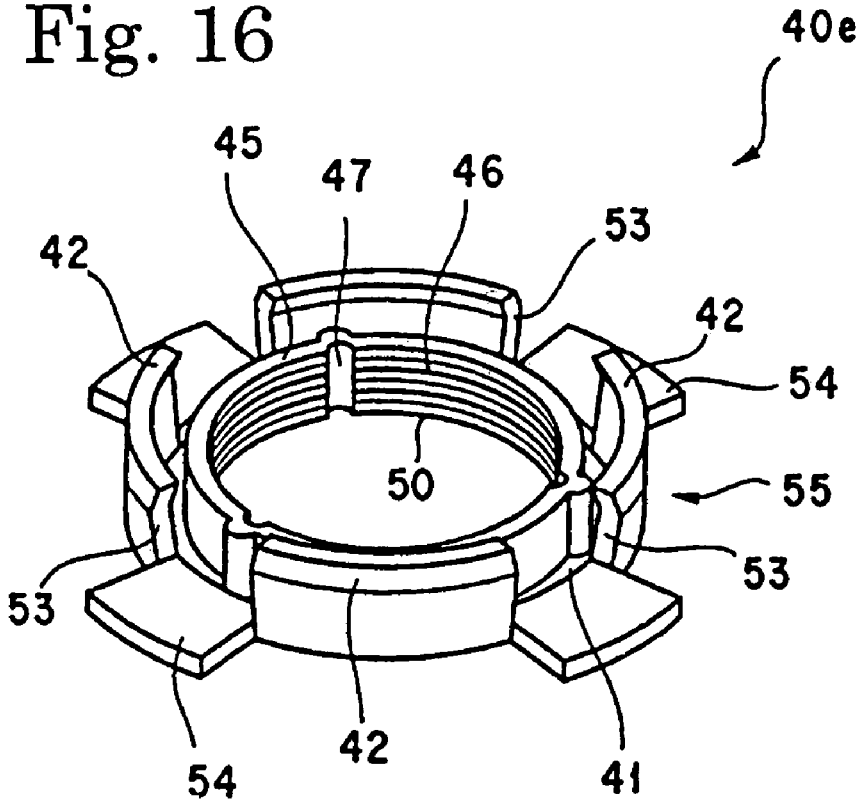
FIG. 16 is a perspective view illustrating the male connector member of Modification Example 7 of the connector of the present invention.

The male connector member 40*e* of the connector shown in FIG. 16 comprises the base part 41, the outer ring part 42, and the inner ring part 45.

A plurality of nail pieces 54 projecting outward in the radial direction are formed in the peripheral edge of the base part 41. The outer ring part 42 is divided by the cutouts 53, and the nail pieces 54 are extending outward from the gaps corresponding to cutouts 53 in the radial direction.

Here, the outer ring part 42 is formed by cutting the rim of the base part 41 formed in the circular shape in the direction of a center and raising the small pieces formed by this cutting in the direction of the inner ring part 45. The operation concave portions 55 lying between the nail pieces 54 are formed in the back of the raised outer ring parts 42.

In FIG. 16, four operation concave portions 55 are formed, and therefore the outer ring part 42 is divided by four cutouts 53.

MODIFICATION EXAMPLE 8

In the above-mentioned Modification Example 7, the size and number of the operation concave portions 55 and the size and number of the cutouts 53 of the outer ring part 42 are not limited to particular ones. For example, as in the case of the female connector member 60*b* of Modification Example 8 shown in FIG. 17, there may be many operation concave portions 75 and there may be many cutouts 73 of the outer ring part 62.

Figure 17:
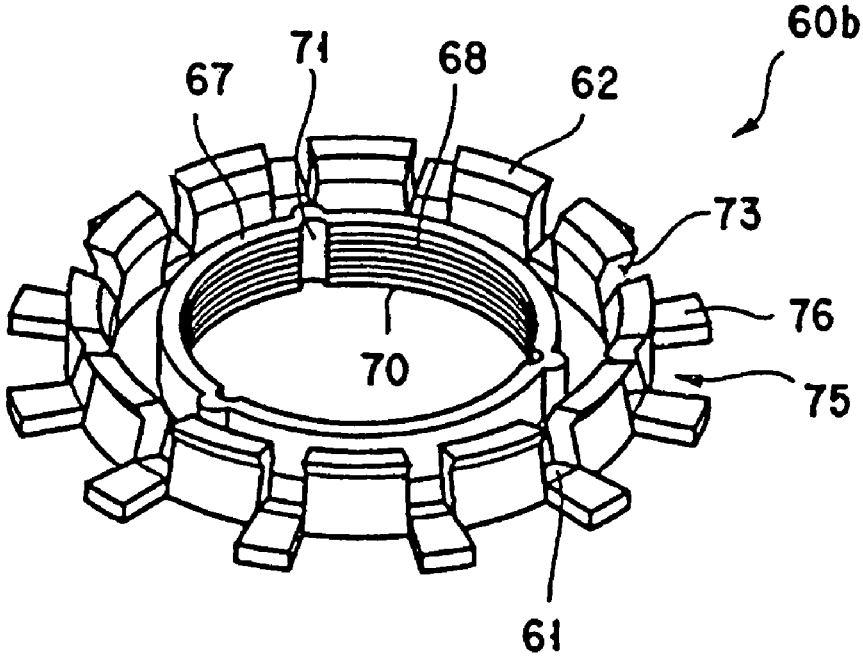
FIG. 17 is a perspective view illustrating the female connector member of Modification Example 8 of the connector of the present invention.

Although Modification Example 8 shown in FIG. 17 is an example of a female connector a member, it may also be applicable to a male connector member. The female connector member 60*b* of the connector shown in FIG. 17 comprises, like the female connector member shown in above-mentioned FIG. 15, the base part 61, the outer ring part 62, and the inner ring part 67 having three groove portions 71 formed in the inner circumferential surface thereof in the axial direction.

The characteristic feature of Modification Example 8 shown in FIG. 17 resides in the points that a plurality of cutouts are formed in the outer ring part 62 and the concave portions 75 are formed in the outer peripheral part of the base part 61 on the outside of the outer ring part 62. A plurality of nail pieces 76 projecting outward in the radial direction are formed in the outer peripheral edge of the base part 61. The outer ring part 62 consisting of a plurality of nail-like portions are divided by a plurality of cutouts 73, and the nail pieces 76 are extending outward from the gaps corresponding to cutouts 73 in the radial direction. Here, a method of forming the outer ring part 62 is the same as that of the case of the male connector member shown in above-mentioned FIG. 16.

According to such Modification Examples 7 and 8, the following effects may be obtained.

(1) Since the operation concave portions 55, 75 are formed between the nail pieces 54, 76 in the back of the outer ring parts 42, 62, it is possible to turn the male connector member 40*e* or the female connector member 60*b* by inserting a finger or a tool in the operation concave portion 55, 75 and hooking the finger or the tool on the nail piece 54, 76. Accordingly, it is possible to easily and quickly attach the male connector member 40*e* or the female connector member 60*b* to a terminal.

(2) Since the formation of the operation concave portions 55, 75 can be performed simultaneously with the formation of the outer ring parts 42, 62, the processing steps will not increase, and thus the operation concave portions 55 may be formed without pushing up the production cost.

(3) The insertion load and the extraction load between the male and female connector members may be adjusted severally by the form of the individual nail-like parts of the outer ring parts 42, 62.

Incidentally, It is needless to say that the present invention is not limited to the above-mentioned embodiments or modification examples and may be modified through a wide range without departing from the principles of the present invention.

For instance, although an electric double layer capacitor cell etc. may be cited as an example of a storage cell, the storage cells to be connected by the connector are not limited to a particular one and may be widely applied to various sizes and uses of storage cells.

Further, although the outer ring part 42 as a male engaging part of the male connector member 40 shown in FIG. 3 and FIG. 9 through FIG. 11 has a ring-like shape with no cutout, slits or cutouts may be formed in the outer ring part in the axial direction to give the elasticity thereto insofar as it can be snap-fastened to the female engaging part (outer ring part 62) of the female connector member 60, and the shape, size, position, or the like of the slit or cutout may be varied variously. The engaging part in the male connect member or the female connector member is the outer ring part, and the engaging force and disengaging force can be adjusted by the modification of the shape of such an engaging part. Further, as shown in FIG. 4 and FIGS. 14-17, although the elasticity is given to the outer ring part of the male connector member or the female connector member by forming slits or cutouts therein, adjustment of engaging force or disengaging force may also be done by changing the depth, width, number, or the like of the slits or cutouts. Furthermore, adjustment of engaging force or disengaging force may also be done by the inclined contour or the angle of inclination of the engaging part (outer ring part) standing from the base part.

Similarly, the outer ring part 62 as a female engaging part of the female connector member 60 may be varied variously. Further, it is not always to form the male engaging part 42 (female engaging part 62) so as to surround the inner ring part 45, 67.

The engaging parts (outer ring parts) of the male and female connector members shown in FIG. 4 and FIGS. 14-17 mentioned above are divided into plural pieces by the slits or the cutouts to increase the elasticity thereof. In case a plurality of slits or cutouts are formed in both engaging parts (outer ring parts) of the male and female connector members in this way, in addition to the best case in which both engaging pieces of the male and female connector members are arranged in the circumference direction in an overlapping state, there may be such a case that in the state of engagement of the male and female connector members the engaging pieces of the outer ring part of one engaging member (the male or female connector member) does not contact the engaging pieces of the other party (the female or male connector member) but may be arranged at the positions corresponding to slits or cutouts. In such a case, the electrical conductivity between the male and female connector members will exhibit increased variation and this will pose a design problem. Such a bad engagement state will be easily arisen when the number of division of the engaging parts of the male and female connector members is the same. Accordingly, it is desirable that the number of division of the engaging parts of the male and female connector members should be a different number to make the variation of the electrical conductivity between the male and female connector members small or to eliminate it.

Next, an embodiment in which the cover unit of the present invention is applied to the connector in the above-mentioned storage module is shown in FIG. 18 through FIG. 22. Incidentally, the structures of the storage module 10, the capacitor cell 20, and the male connector member 40 and the female connector member 60 of the connector are the same as those of the first embodiment mentioned above, their descriptions will be omitted.

Figure 19:
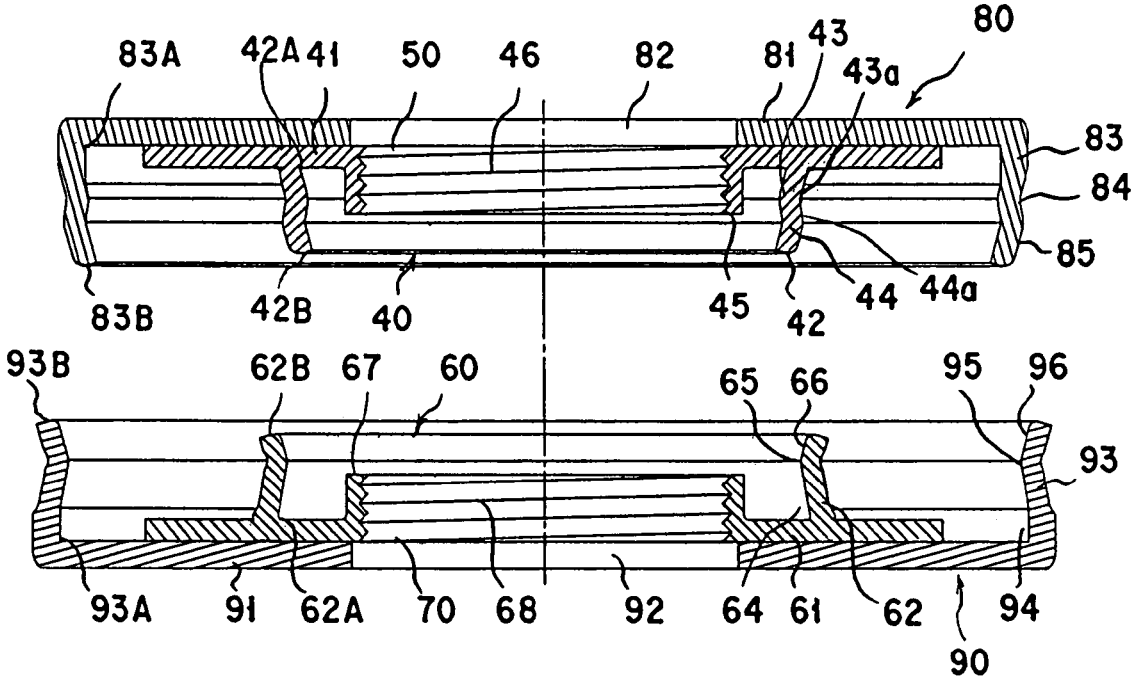
FIG. 19 is a cross-sectional view illustrating the male connector member of the connector/the male cover member of the cover unit and the female connector member of the connector/the female cover member of the cover unit in the storage module shown in FIG. 18 as being arranged in the opposed state.
Figure 20:
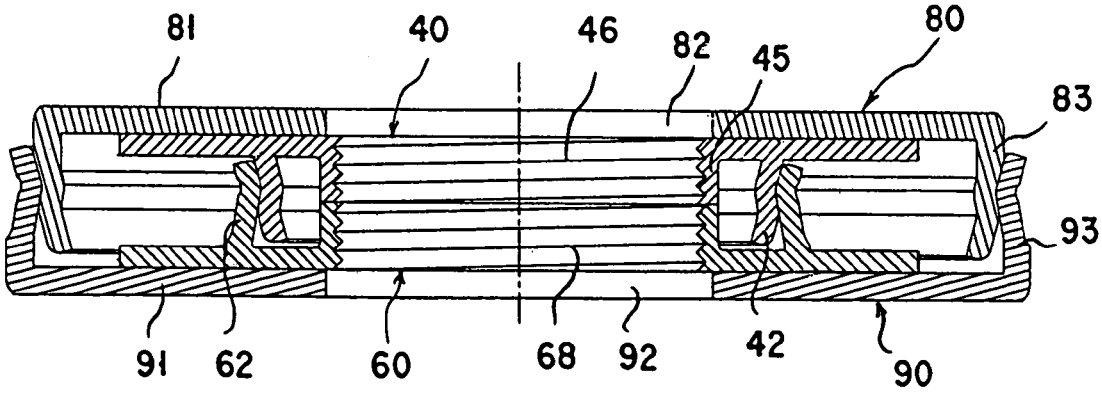
FIG. 20 is a cross-sectional view illustrating the snap-in-fitted state of the male connector member of the connector/the male cover member of the cover unit and the female connector member of the connector/the female cover member of the cover unit in the storage module shown in FIG. 18.

The cover unit of the present invention comprises a couple of a male cover member 80 and a female cover member 90 each having a disk-like base plate 81, 91 provided with an opening 82, 92 in the center thereof and a circumferential wall part 83, 93 of a predetermined height annularly raised in the periphery thereof, as clearly shown in FIG. 19. The diameter of the opening 82, 92 is slightly larger than that of the terminal 26 of the above-mentioned capacitor cell 20.

The circumferential wall part 83 of the male cover member 80 has a shape similar to the outer ring part 42 of the male connector member of the connector and has a contour of substantially letter "S" curved toward the upper opening end side 83B, as shown in FIG. 19.

Although the outside surface of the circumferential wall part 83 has the diameter gradually decreasing inward from the base end side 83A toward the opening end side 83B, the diameter begins to increase after a substantially middle portion. A male side engaging concave portion 84 is formed in this transition position between the reduced diameter portion and the enlarged diameter portion and a male side guiding surface 85 is formed by a tapered surface of which diameter decreases toward the opening end side 83B.

The circumferential wall part 83 has elasticity. When the pressing force is added to the circumferential wall part 83 from its outside toward its inside, the diameter of the opening end side 83B will decrease slightly in the radial direction, and if the pressing force is removed, it will restore to the original diameter owing to the elastic restoring force.

On the other hand, the circumferential wall part 93 of the female cover member 90 has a shape similar to the outer ring part 62 of the female connector member of the connector and has a ring-like curved contour of which diameter is gradually decreases from base end side 93A and slightly increasing from a position near the upper opening end side 93B, as shown in FIG. 19. Although the diameter of the inner circumferential surface of the circumferential wall part 93 gradually decreases from the base end side 93A toward the opening end side 93B, it begins to increase on the way. A fitting concave portion 94 is formed in the portion whose diameter is decreased, and a female side guiding surface 96 is formed by the tapered surface whose diameter is increased toward the opening end side 93B. Further, a female side engaging protruded part 95 is formed by the inner surface of a position of which diameter decreasing from base end side 93A is changed to increase.

Next, the assembly of storage apparatus 1 using such components will be described.

Figure 21:
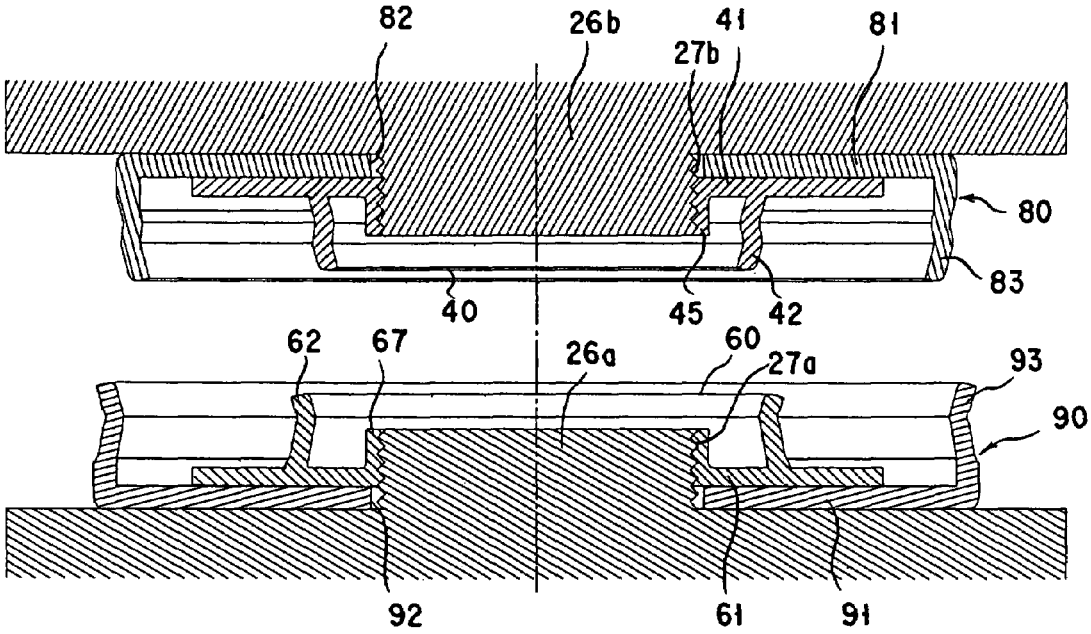
FIG. 21 is a cross-sectional view illustrating the male connector member of the connector/the male cover member of the cover unit and the female connector member of the connector/the female cover member of the cover unit in the storage module shown in FIG. 18, all members being attached to the respective terminals, as being arranged in the opposed state.

First, a plurality of capacitor cells 20 are prepared, and cover units and connectors are attached to the terminals 26*a* and 26*b* of the capacitor cells 20, respectively. At this time, since the male screw parts 27*a* and 27*b* are formed in the terminals 26*a* and 26*b* of each capacitor cell 20, first the male cover member 80 (or the female cover member 90) of the cover unit is attached to the terminal 26*b* (or 26*a*), and then the female screw part 46 (or 68) formed in the inner ring part 45 (or 67) of the male connector member 40 (or the female connector member 60) of the connector 30 are screwed onto the male screw part 27*b* (or 27*a*) of the terminal 26*b* (or 26*a*) to fasten them in the state that the base plate 81 (91) of the male cover member 80 (or the female cover member 90) is nipped with the base part 41 (or 61) of the male connector member 40 (or the female connector member 60) and the terminal 26*b* (or 26*a*), as shown in FIG. 21.

Figure 18:
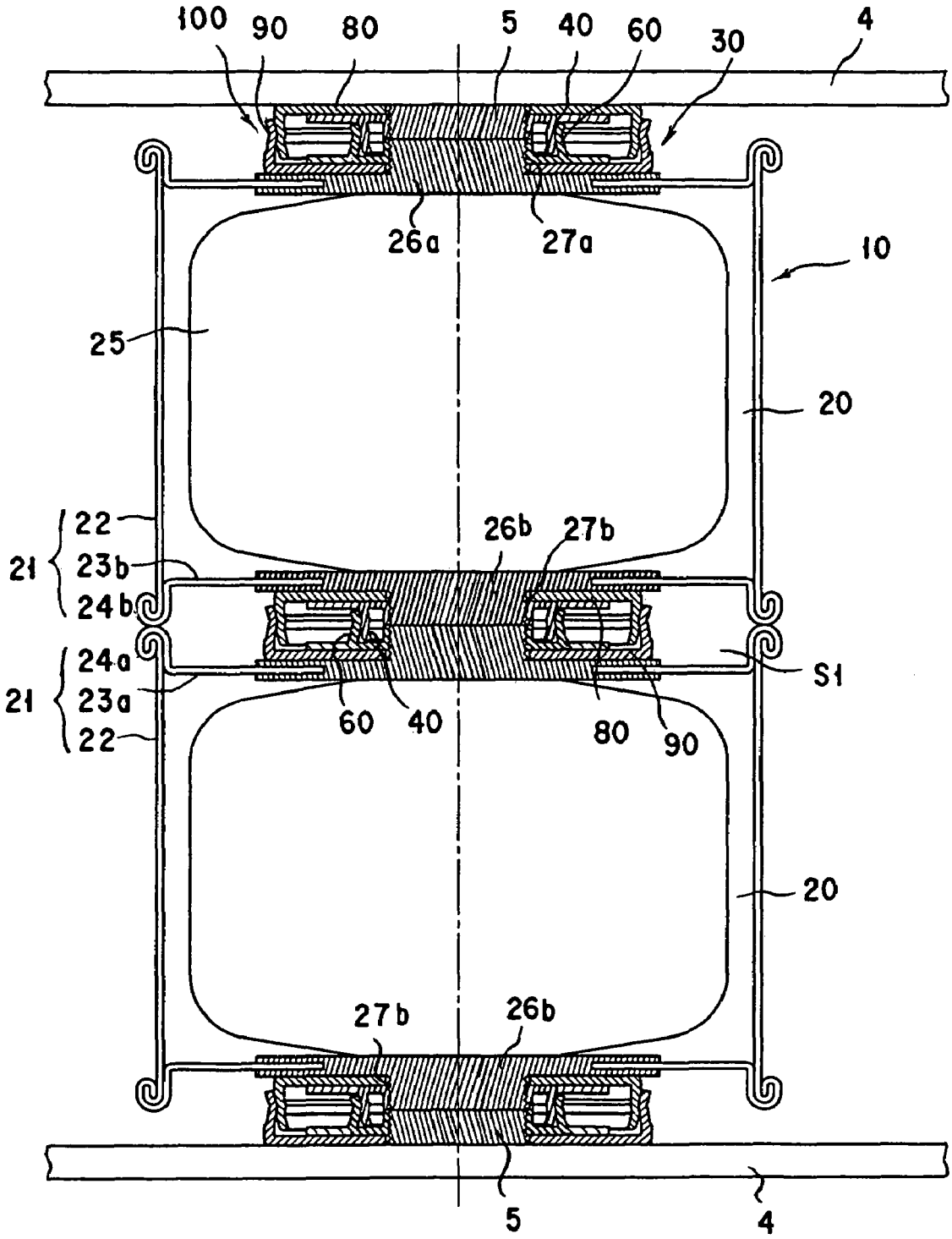
FIG. 18 is a fragmentary cross-sectional view schematically illustrating another embodiment of the storage module in the storage apparatus.

Further, two bus plates 4 are prepared and the connector 30 (male connector member 40, female connector member 60) is attached to the terminal 5 of the bus plate 4 (refer to FIG. 18).

Figure 22:
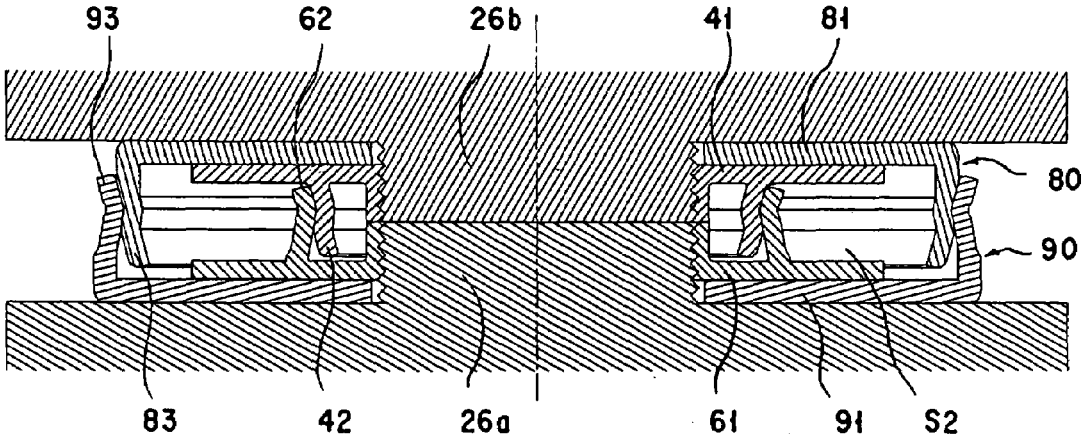
FIG. 22 is a cross-sectional view illustrating the snap-in-fitted state of the male connector member of the connector/the male cover member of the cover unit and the female connector member of the connector/the female cover member of the cover unit in the storage module shown in FIG. 21, all members being attached to the respective terminals.
Figure 23:
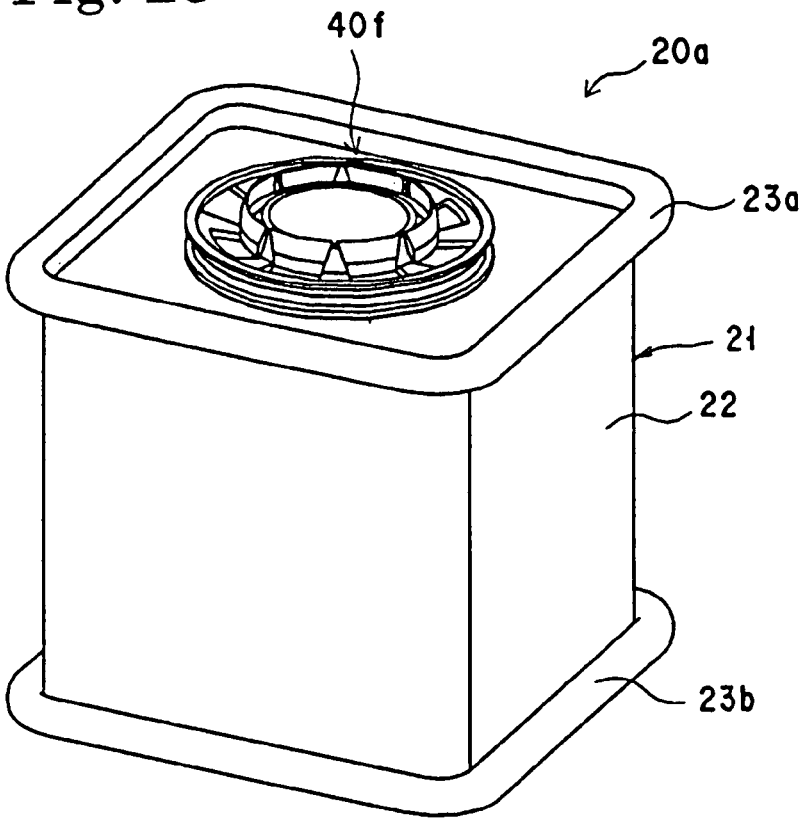
FIG. 23 is a schematic perspective view illustrating another embodiment of the storage cell of the present invention.
Figure 24:
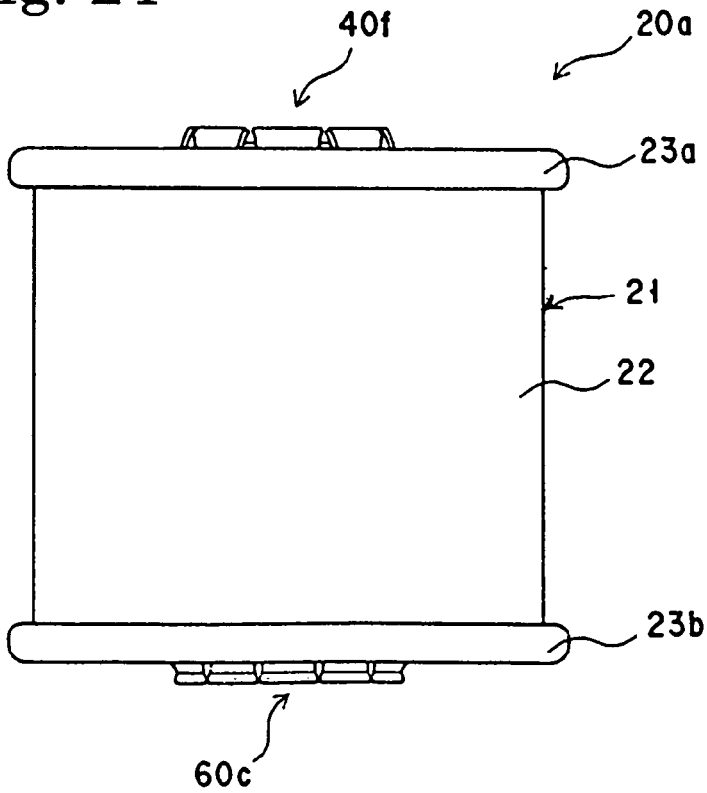
FIG. 24 is a schematic side view of the storage cell shown in FIG. 23.

Two capacitor cells 20 are connected through the medium of the connection of the male connector member 40 of the connector 30 with the female connector member 60 thereof to constitute the storage module 10. At this time, the male connector member 40 and the female connector member 60 of the connector 30 as well as the male cover member 60 and the female cover member 80 of the cover unit are attached to each other by the snap operation, respectively, as shown in FIG. 22. Since the connector 30 is made of a conductive material (for example, tough pitch copper), the capacitor cells 20 are electrically connected to each other at the same the male connector member 40 and the female connector member 60 are connected to each other by fitting.

Incidentally, the snap operation of the male cover member 80 and the female cover member 90 of the cover unit is completely the same as that of the male connector member 40 and the female connector member 60 of the connector described hereinbefore, their descriptions will be omitted.

According to the above-mentioned embodiment, the male cover member and the female cover member of cover unit function as the centering guide at the time of snap-in-fitting. As a result, the operation characteristics at the time of engagement is markedly improved and such problems as the deviation of the center positions of the male and female connector members of the connector and the damages of the engaging parts may be solved. Further, since the closed space S2 is formed by the male cover member and the female cover member of the cover unit when the male cover member is guided into the female cover member and the connected part between terminals by means of the connector lies in this space, the dust proofness and the drip proofness are greatly improved, and the attachment of dust and liquid to the connected part between terminals is prevented effectively.

If the respective end faces of the inner ring parts of the male and female connector members of the connector of the present invention abut against each other when the engagement is done with the respective outer ring parts, the connector will excel in the electrical characteristics. The connection structure of such storage cells will be described with reference to the drawings.

Figure 25:
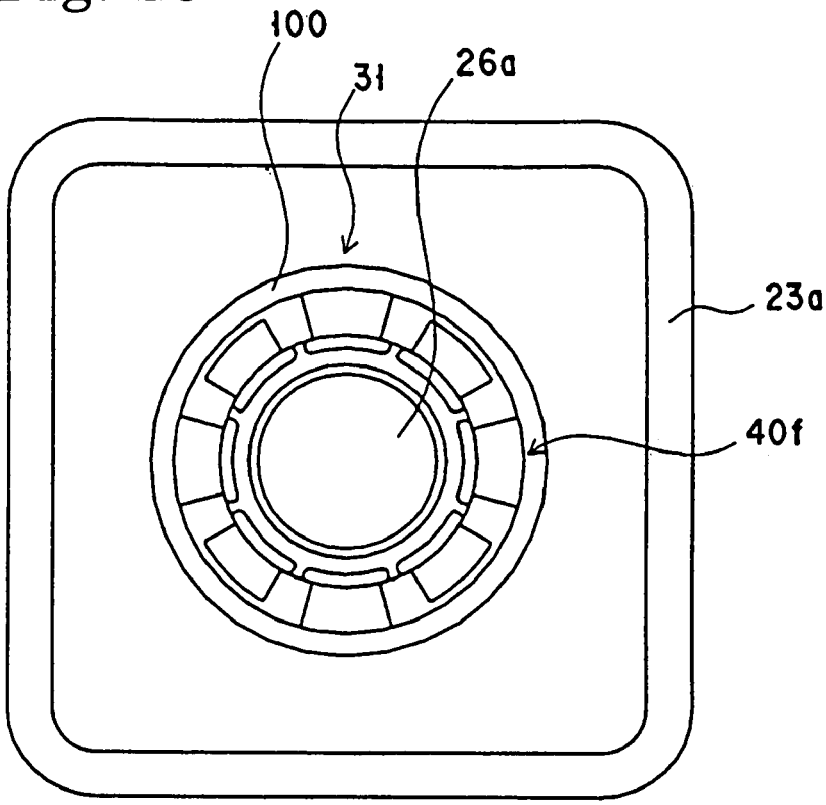
FIG. 25 is a schematic plan view of the storage cell shown in FIG. 23.
Figure 26:
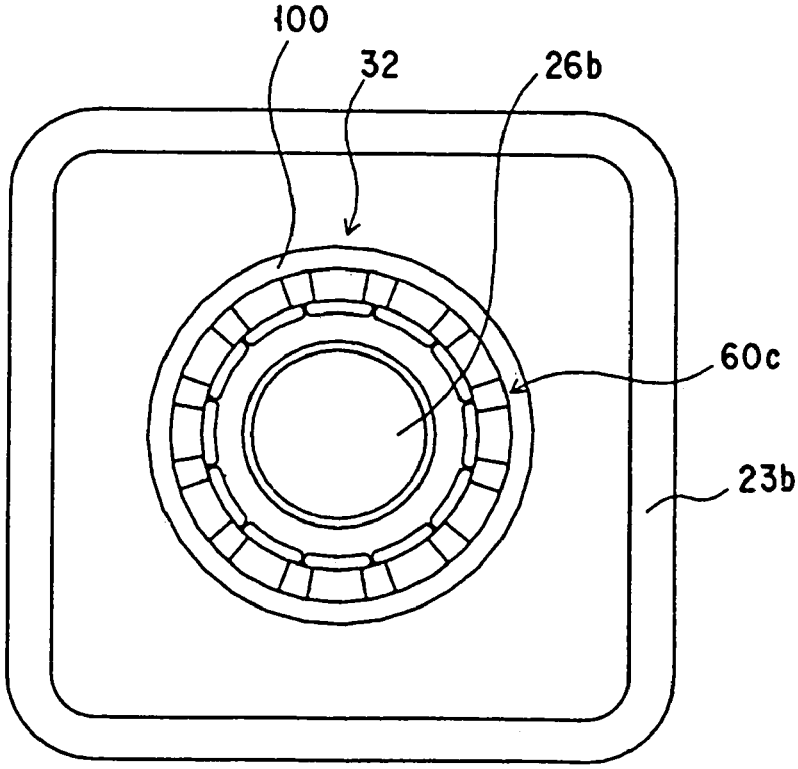
FIG. 26 is a schematic bottom view of the storage cell shown in FIG. 23.

FIG. 23 through FIG. 26 illustrate a storage cell 20*a* which is an electric double layer capacitor, for example. The storage cell 20*a* is a cube type capacitor and equipped with a case 21 (a body) which is a barrel type can having the shape of substantially cube. The internal elements (not shown) are accommodated in the case 21. The internal elements comprises cathodes and anodes alternately superposed while interposing a separator therebetween. An upper lid 23*a* and a lower lid 23*b* are fixedly secured to the upper part and the lower part of a side plate 22 of the case 21, respectively. A male terminal part 31 shown in FIG. 25 is formed in the upper lid 23*a*. On the other hand, a female terminal part 32 shown in FIG. 26 is formed in the lower lid 23*b*. The connection structure of the storage cells 20*a* of this embodiment is constituted by the male terminal part 31 and the female terminal part 32.

Figure 27:
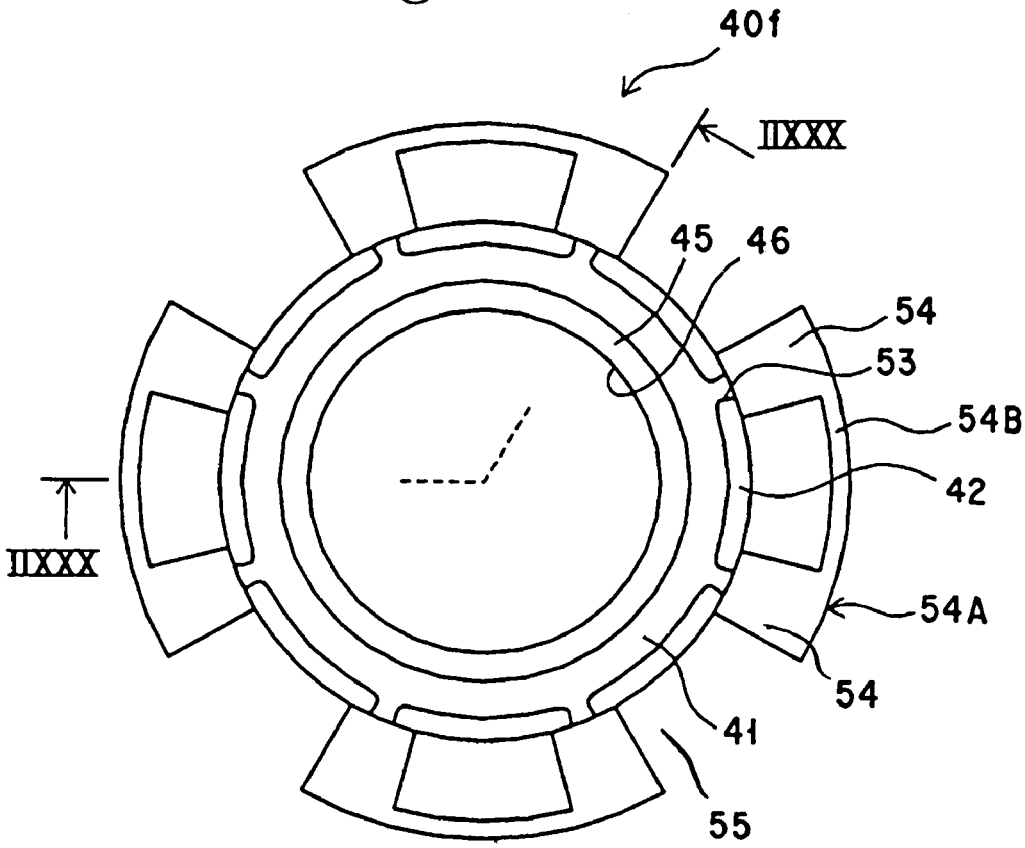
FIG. 27 is a plan view of the male connector member of the connector used in the storage cell shown in FIG. 23.
Figure 28:
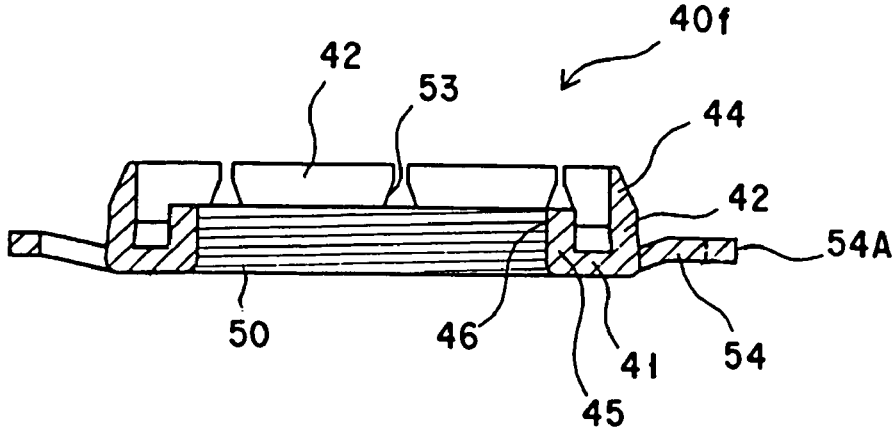
FIG. 28 is a cross-sectional view of the male connector member shown in FIG. 27 taken along the line IIXXX-IIXXX.
Figure 31:
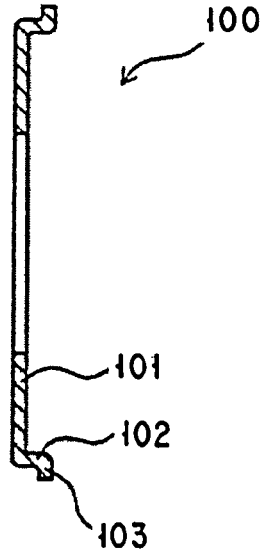
FIG. 31 is a cross-sectional view of a washer used in the storage cell shown in FIG. 23.
Figure 32:
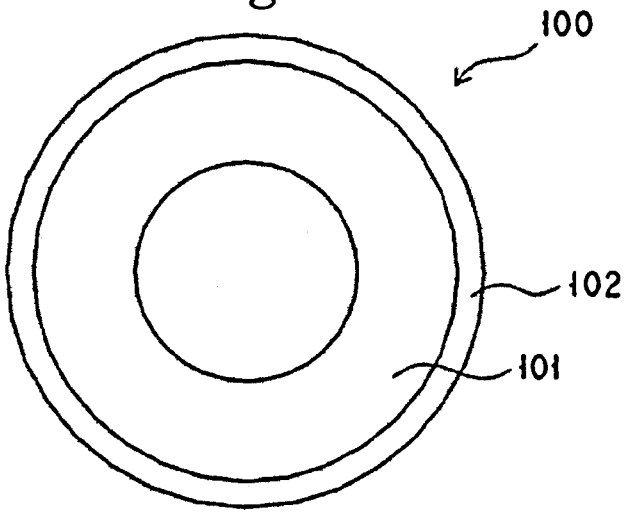
FIG. 32 is a plan view of the washer shown in FIG. 31.

Construction of Terminal Part:

The male terminal part 31 comprises an external terminal 26*a* fixedly secured to the upper lid 23*a* so that one end part thereof projects from the central hole portion of the upper lid 23*a*, as shown in FIG. 25. Another end of the external terminal 26*a* located in the case 21 is electrically connected to the cathodes of the internal elements accommodated in the case 21. A male screw part is formed in the outer circumferential surface of the external terminal 26*a*, to which the male connector member 40*f* shown in FIG. 27 and FIG. 28 is screwed. A cover member or washer 100 shown in FIG. 31 and FIG. 32 is interposed and fastened between the upper lid 23*a* and the male connector member 40*f*. Incidentally, since the washer 100 used in this embodiment differs from the above mentioned male and female cover members whether it can be snap-fastened or not, the term "washer" is used hereinafter.

Figure 29:
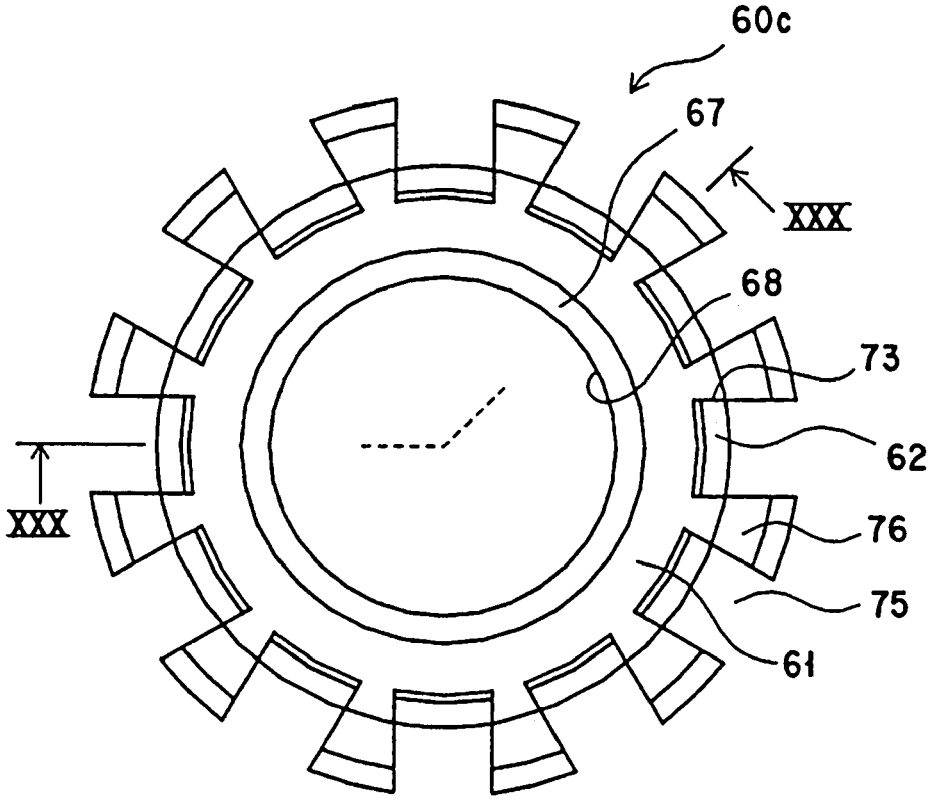
FIG. 29 is a plan view of the female connector member of the connector used in the storage cell shown in FIG. 23.
Figure 30:
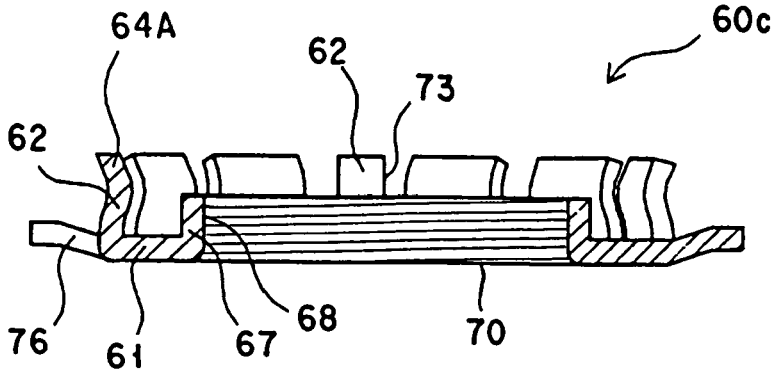
FIG. 30 is a cross-sectional view of the female connector member shown in FIG. 29 taken along the line XXX-XXX.

On the other hand, the female terminal part 32 comprises an external terminal 26*b* fixedly secured to the lower lid 23*b* so that one end part thereof projects from the central hole portion of the lower lid 23*b*, as shown in FIG. 26. Another end of the external terminal 26*b* located in the case 21 is electrically connected to the anodes of the internal elements accommodated in the case 21. A male screw part is formed in the outer circumferential surface of the external terminal 26*b*, to which the female connector member 60*c* shown in FIG. 29 and FIG. 30 is screwed. The washer 100 shown in FIG. 31 and FIG. 32 is interposed and fastened between the lower lid 23*b* and the female connector member 60*c*.

The male connector member 40*f* shown in FIG. 27 and FIG. 28 has the ring-like base part 41, and the cylindrical inner ring part 45 is standing from the inner peripheral portion around the inner hole 50 of the base part 41. The female screw part 46 is formed in the inner circumferential surface of the inner ring part 45. The cylindrical outer ring part 42 is standing from the outer peripheral portion of the base part 41. The outer ring part 42 has cutouts 53 formed in the circumferential direction at equal intervals. In the upper end portion of the outer ring part 42, an enlarged diameter portion 44 of which diameter gradually increases downward in the radial direction is formed. The enlarged diameter portion 44 has elasticity. In the outer peripheral edge of the base part 41, four nail parts 54A are formed at equal intervals so as to project outward in the radial direction, and the operation concave portions 55 are formed between adjoining nail parts 54A. The nail part 54A is composed of a couple of adjoining nail pieces 54 formed in the position corresponding to the above-mentioned cutouts 53 and a connection part 54B which connects the leading ends of these nail pieces 54. Each nail part 54A are gradually raised upward in the radial direction.

The female connector member 60*c* shown in FIG. 29 and FIG. 30 has the ring-like base part 61, and the cylindrical inner ring part 67 is standing from the inner peripheral portion around the inner hole 70 of the base part 61. The female screw part 68 is formed in the inner circumferential surface of the inner ring part 67. The cylindrical outer ring part 62 is standing from the outer peripheral edge of the base part 61. The cutouts 73 are formed in the outer ring part 62 at equal intervals in the circumferential direction. In the upper end portion of the outer ring part 62, a reduced diameter portion 64A of which diameter gradually decreases downward in the radial direction is formed. The reduced diameter portion 64A has elasticity. In the outer peripheral edge of the base part 61, twelve nail pieces 76 are formed at equal intervals in the positions corresponding to the above-mentioned cutouts 73 so as to project outward in the radial direction, and the operation concave portions 75 are formed between adjoining nail pieces 76. Each nail piece 76 is gradually raised upward in the radial direction.

The above-mentioned connector members 40*f* and 60*c* are formed from a plate material. For instance, the inner ring parts 45 and 67 and the outer ring parts 42 and 62 are formed by cutting the plate material and raising the cut pieces in the same direction, and the nail pieces 54 and 76 consist of a remainder areas left behind between the outer ring parts 42 and 62.

FIG. 31 and FIG. 32 illustrate the washer 100. The washer 100 has a ring-like base part 101, and a circumferential wall part 102 is standing from the outer peripheral edge of the base part 101. A collar 103 is formed on the upper end of the circumferential wall part 61 so as to extend outward in the radial direction.

Attachment of Terminal Part to Storage Cell:

In the attachment of the male connector member 40*f* to the upper lid 23*a*, the male connector member 40*f* is fixedly secured to the external terminal 26*a* by screwing the female screw part 46 formed in the inner circumferential surface of the inner ring part 45 of the male connector member 40*f* onto the male screw part formed in the outer circumferential surface of the external terminal 26*a*. At this time, the washer 100 is fixedly secured to the upper lid 23*a* by being interposed and fastened between the male connector member 40*f* and the upper lid 23*a*.

Figure 33:
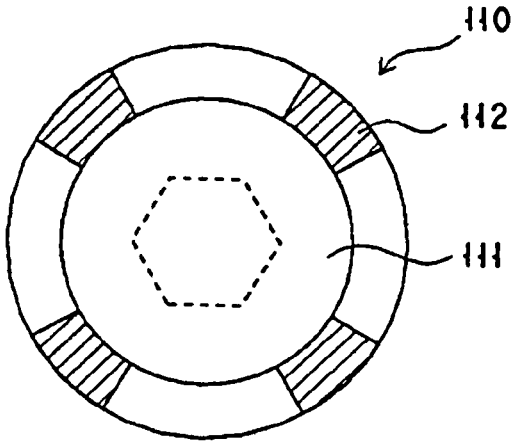
FIG. 33 is a transverse cross-sectional view illustrating a fastening jig to be used for fastening the male connector member shown in FIG. 27 to a terminal.
Figure 36:
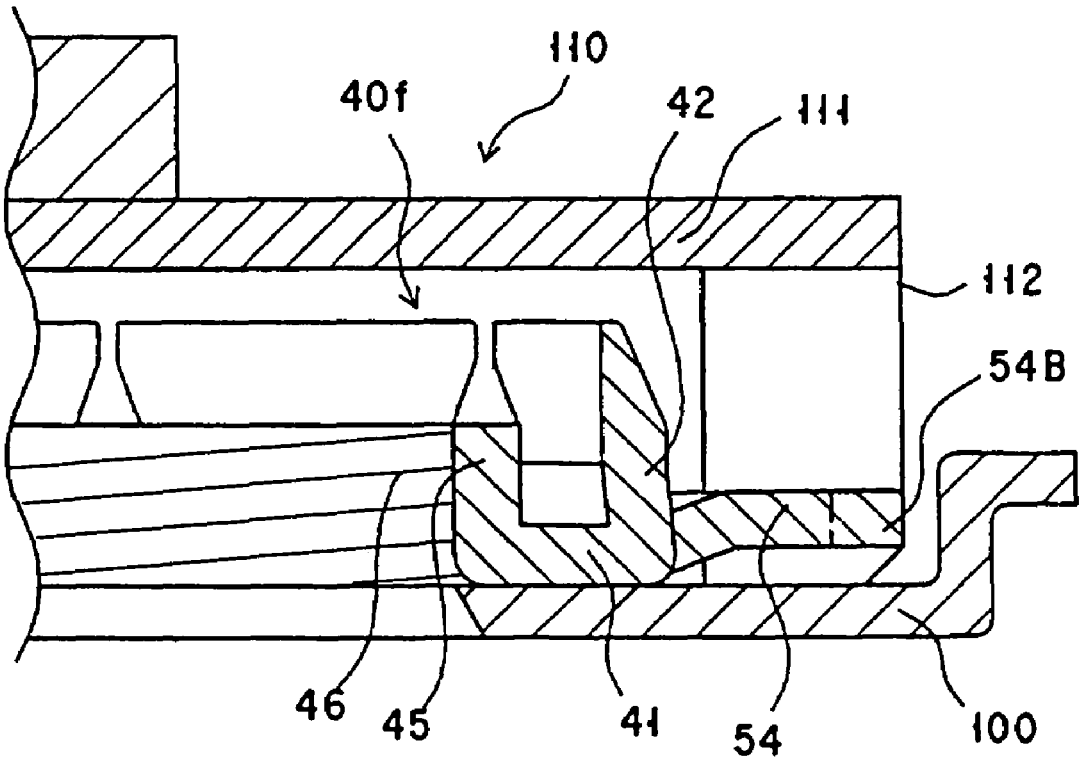
FIG. 36 is a cross-sectional view illustrating the engaged state of the fastening jig shown in FIG. 33 to the male connector member shown in FIG. 27.

In the screwing mentioned above, a fastening jig 110 shown in FIG. 33 is used. The fastening jig 110 has four projected parts (tooth) 112 formed in the underside of a disk-like base part 111 at equal intervals in the circumferential direction, as shown in FIG. 33 and FIG. 36. The projected parts 112 are formed in the positions corresponding to the operation concave portions 55 formed between the nail parts 54A of the male connector member 40*f*. When the male connector member 40*f* is screwed onto the external terminal, the fastening jig 110 is arranged so that the projected parts 112 of the fastening jig 110 are positioned in the operation concave portions 55, respectively. Thereafter, when the fastening jig 110 is turned, the projected parts 112 will abut against the nail pieces 54. Here, since the nail pieces 54 are gradually raised upward in the radial direction as are shown in FIG. 28, the areas of the projected parts 112 abutting against the nail pieces 54 become large as shown in FIG. 36. As a result, it is possible to prevent the projected parts 112 from separation from the operation concave portions 55 formed between nail parts 54A during the screwing of the male connector member 40*f*.

Figure 34:
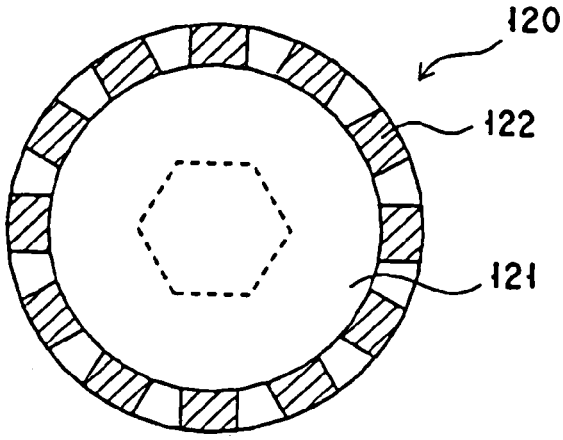
FIG. 34 is a transverse cross-sectional view illustrating a fastening jig to be used for fastening the female connector member shown in FIG. 29 to a terminal.

Similarly, in the screwing of the female connector member 60*c* onto the external terminal, the fastening jig 120 as shown in FIG. 34 is used and the attachment to the external terminal 26*b* is performed according to the same procedure as described above in connection with the male connector member. The fastening jig 120 has twelve projected parts (tooth) 122 formed in the underside of a disk-like base part 121 at equal intervals in the circumferential direction. The projected parts 122 are formed in the positions corresponding to the operation concave portions 75 formed between the nail pieces 76 of the female connector member 60*c*. When the female connector member 60*c* is screwed onto the external terminal, the fastening jig 120 is arranged so that the projected parts 122 of the fastening jig 120 are positioned in the operation concave portions 75 formed between the nail pieces 76 of the female connector member 60*c*, respectively. Thereafter, when the fastening jig 120 is turned, the projected parts 122 will abut against the nail pieces 76. Here, since the nail pieces 76 are gradually raised upward in the radial direction as are shown in FIG. 30, the areas of the projected parts 122 abutting against the nail pieces 76 become large. As a result, it is possible to prevent the projected parts 122 from separation from the operation concave portions 75 formed between nail pieces 76 during the screwing of the female connector member 60*c*.

Figure 35:
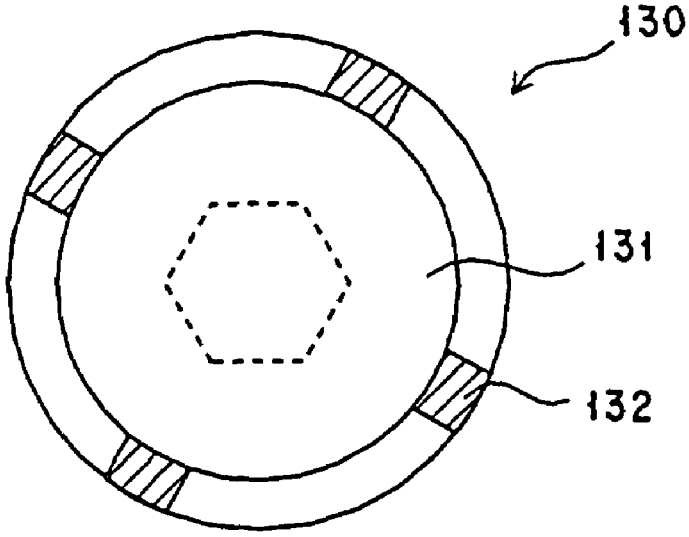
FIG. 35 is a transverse cross-sectional view illustrating another embodiment of the fastening jig to be used for fastening the male connector member and the female connector member to a terminal.

Here, in case the number of nail pieces 54, 76 of the male connector member 40*f* and the female connector member 60*c* is several times the number of the projected parts of the fastening jig, a common fastening jig 130 as shown in FIG. 35 can be used. The fastening jig 130 has four projected parts 132 formed in the underside of a disk-like base part 131 at equal intervals in the circumferential direction. The projected part 132 has the substantially same shape as the projected part 122.

Figure 37:
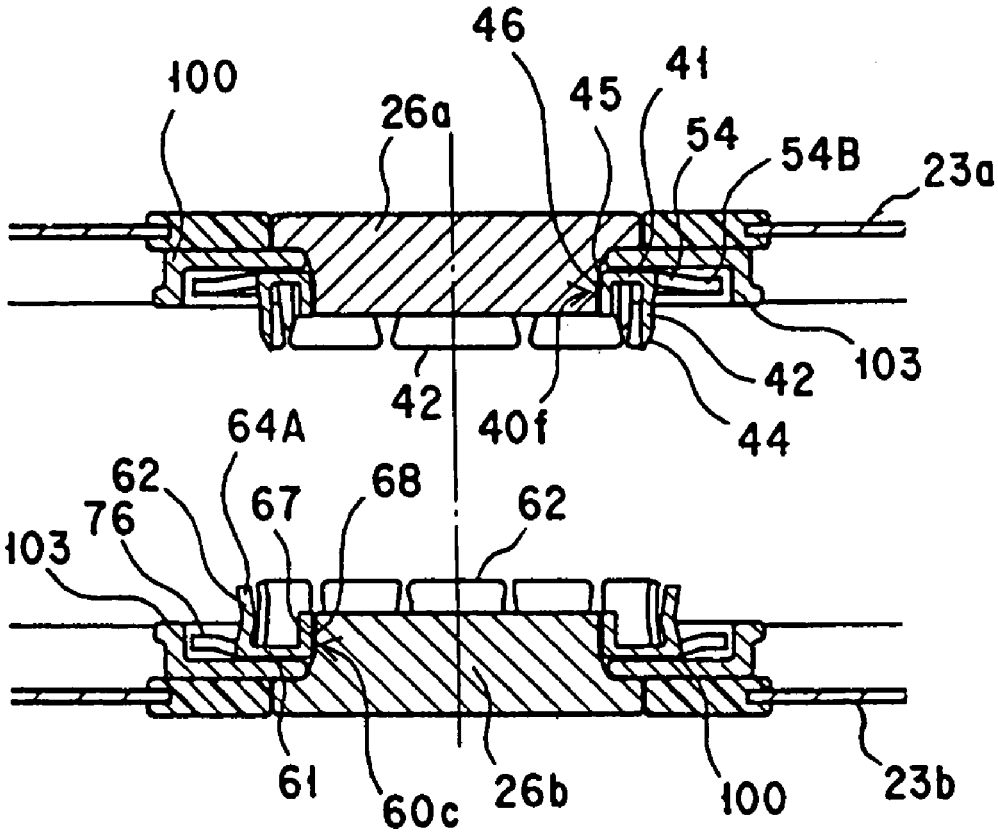
FIG. 37 is a cross-sectional view illustrating the male connector member shown in FIG. 27 and the female connector member shown in FIG. 29, both members being attached to the respective terminals, as being arranged in the opposed state.
Figure 38:
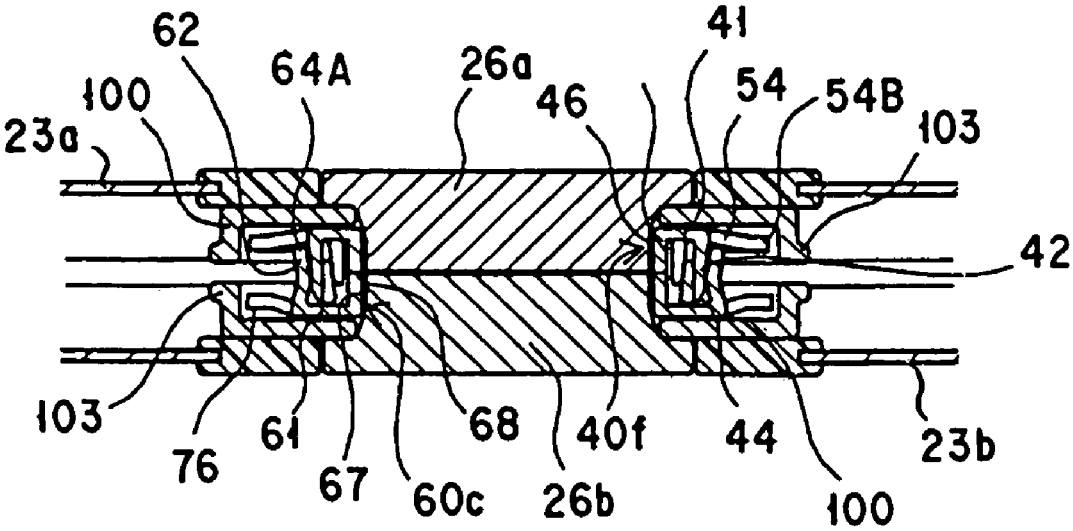
FIG. 38 is a cross-sectional view illustrating the snap-in-fitted state of the male connector member and the female connector member of the connector shown in FIG. 37, both members being attached to the respective terminals.

Connection of Storage Cells:

Next, connecting operation of a plurality of storage cells 20*a* will be described with reference to FIGS. 37 and 38. As shown in FIG. 37, the male connector member 40*f* of one storage cell 20*a* and the female connector member 60*c* of the other storage cell 20*a* are arranged as opposed to each other, and the outer ring part 42 of the male connector member 40*f* is inserted into the outer ring part 62 of the female connector member 60*c*. Then, the end faces of the inner ring part 45 of the male connector member 40*f* and of the inner ring part 67 of the female connector member mutually opposed in the axial direction abut against each other, as shown in FIG. 38. At this time, since the outer circumferential surface of the outer ring part 42 of the male connector member 40*f* is pressed to the inner circumferential surface of the outer ring part 62 of the female connector member 60*c*, thereby causing the frictional force, the male connector member 40*f* and the female connector member 60*c* are fixedly secured to each other. In this case, the enlarged diameter portion 44 formed in the leading end of the outer ring part 42 of the male connector member 40*f* and the reduced diameter portion 64A formed in the leading end of the outer ring part 62 of the female connector member 60*c* are mutually pressed elastically, the fixation of the male connector member 40*f* and the female connector member 60*c* becomes firm. On the other hand, the positioning of the male connector member 40*f* and the female connector member 60*c* in the axial direction is effected by the abutment of the mutually opposed end faces of the inner ring part 45 and of the inner ring part 67 mentioned above. Further, since the counterforce generates in the mutually abutted end faces, the relative turning of the male connector member 40*f* and the female connector member 60*c* may be prevented. Accordingly, the fixation of the male connector member 40*f* and the female connector member 60*c* becomes still firmer.

Figure 39:
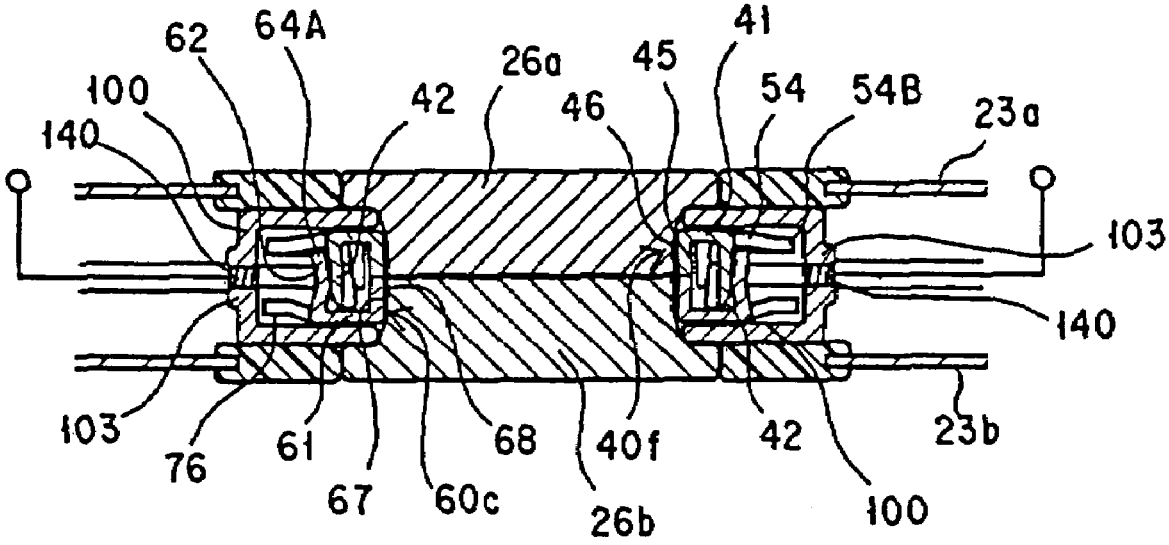
FIG. 39 is a cross-sectional view for explaining the operation of voltage detection in the state of connection of the male connector member with the female connector member shown in FIG. 38.

Voltage Detection of Storage Cell:

Next, the voltage detection of storage cells 20*a* connected as mentioned above will be described with reference to FIG. 39. In the voltage detection of the conventional storage cells, two conductor pieces which are different members from the male and female connector members are screwed onto the external terminals 26*a* and 26*b*, respectively. on the other hand, the voltage detection of storage cells 20*a* according to this embodiment is performed by using two washers 100 fastened between the male and female connector members 40*f*, 60*c* and the lids 23*a*, 23*b*, respectively, and interposing a conductor 140 between the collars 103 of their circumferential wall parts 102. Therefore, since there is no need to screw the conductor pieces which are different members from the male and female connector members onto the external terminals 26*a* and 26*b*, it is possible to reduce the number of parts, and the voltage detection can be easily performed only by interposing the conductor 140 between the collars 103 of two washers 100 as described above.

Here, the male connector member 40*f* and/or the female connector member 60*c* may also be formed integrally with the washer 100, respectively. In this case, since the number of parts of the storage cell 20*a* may be decreased, the assembly time of the storage cell can be shortened, and weight-saving of the storage cell can be realized.

Figure 40:
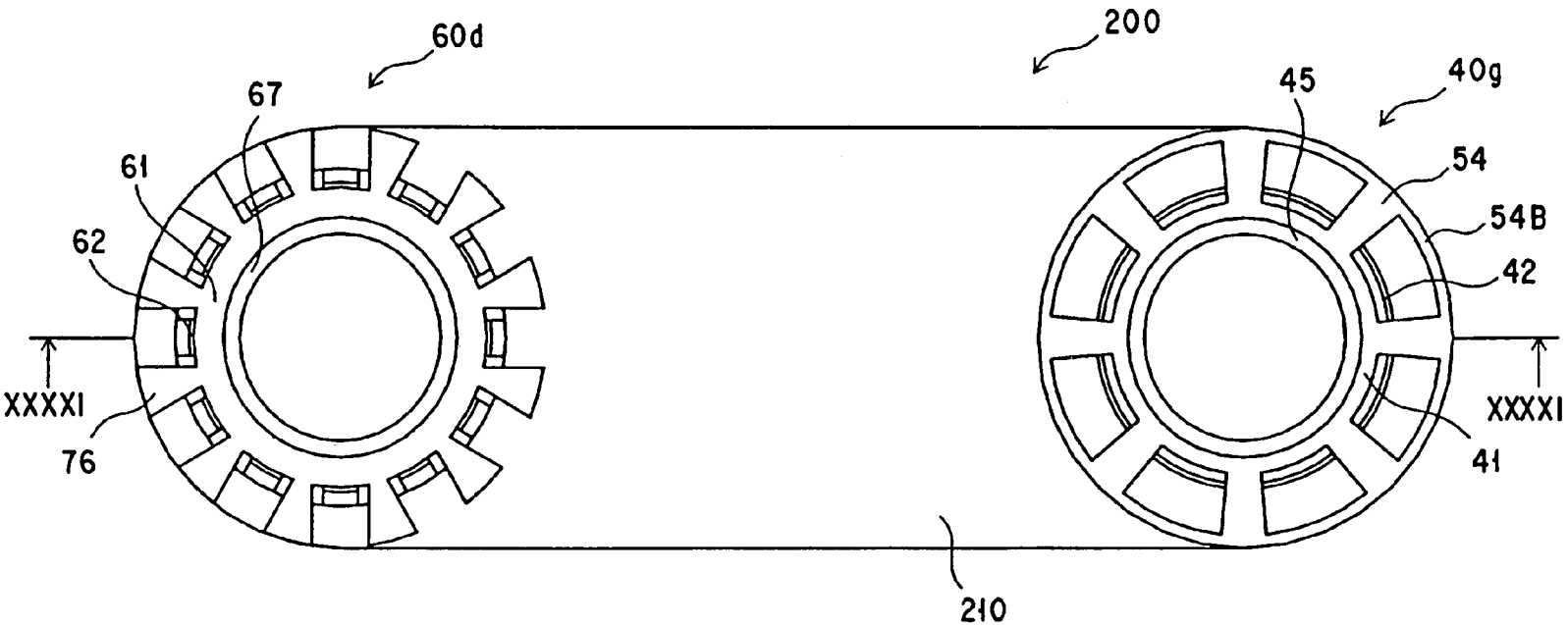
FIG. 40 is a plan view of a bus bar according to the present invention.
Figure 41:
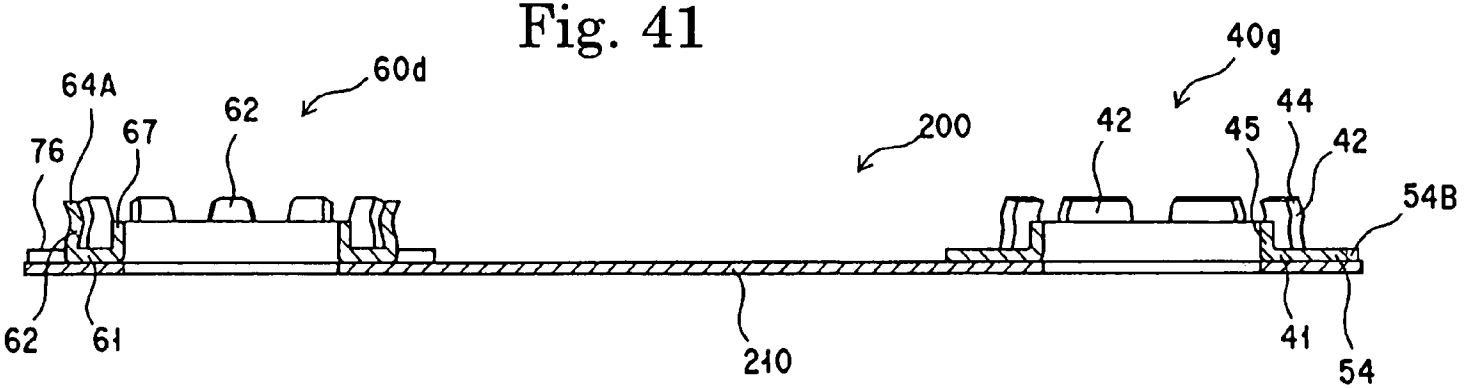
FIG. 41 is a cross-sectional view of the bus bar shown in FIG. 40 taken along the line XXXXI-XXXXI.

Next, one embodiment of the bus bar according to the present invention will be described with reference to FIG. 40 and FIG. 41. Incidentally, the same reference numerals will be given to the same component elements as the embodiment of the above-mentioned storage cell 20*a*, and the descriptions thereof will be omitted.

A bus bar 200 comprises a rectangular bus bar plate 210. To one end portion of the bus bar plate 210 the male connector member 40*g* is fixedly secured by welding and to the other end the female connector member 60*d* is fixedly secured by welding. Although the male connector member 40*g* differs from the embodiment shown in FIG. 27 and FIG. 28 mentioned above in the points that a plurality of nail pieces 54 are connected by the connection part 54B over the whole outer periphery, and that the nail pieces 54 are not gradually raised upward in the radial direction, but is evenly formed along the upper surface of the bus bar plate 210, other structures are the same. Such nail pieces 54 are used as a welding area. Similarly, although the female connector member 60*d* differs from the embodiment shown in FIG. 29 and FIG. 30 mentioned above in the point that a plurality of nail pieces 76 are not gradually raised upward in the radial direction, but is evenly formed along the upper surface of the bus bar plate 210, other structures are the same. Such nail pieces 76 are used as a welding area.

In the above-mentioned bus bar 200, the female connector member 60*c* of one storage cell 20*a* is connected to the male connector member 40*g*, and the male connector member 40*f* of the other storage cell 20*a* is connected to the female connector member 60*d*. In case a great number of storage cells are connected by the use of a plurality of bus bars, a plurality of bus bars may be arranged as a zigzag lattice form.

Hereinafter, a working example and a comparative example which have concretely confirmed the effect obtained by subjecting a connector to the plating process according to the present invention will be described.

EXAMPLE 1

A snap-in-fitting connector manufactured from a corson alloy (CAC60 manufactured by KOBE STEEL, Ltd.) was subjected to degreasing, rinsing, acid activation, and rinsing in the usual way, and then subjected to nickel plating in a Ni plating bath containing 250 g/liter of $NiSO_4.6H_2O$, 50 g/liter of $NiCl_2.6H_2O$, 50 g/liter of $H_3BO_3$, and a small amount of an additive under the following conditions; temperature: 50° C., pH: 4, electric current: 150 A, and duration: 60 minutes. Thereafter, the connector was subjected to rinsing and then dewatering-drying.

Next, the resultant connector was subjected to degreasing, rinsing, acid activation, and rinsing in the usual way, and then subjected to Cu—Sn plating in a Cu—Sn plating bath containing 7.5 g/liter of Cu, 30 g/liter of Sn, 30 g/liter of KOH, 50 g/liter of KCN, and a small amount of an additive under the following conditions; temperature: 60° C., electric current: 150-200 A, and duration: 20 minutes. Thereafter, the connector was subjected to rinsing, rinsing in hot water, and then dewatering-drying.

Further, the resultant connector was subjected to degreasing, rinsing, acid activation, and rinsing in the usual way, and then subjected to tin plating in a Sn plating bath containing 20 g/liter of Sn, 6-10% of $H_2SO_4$, and a trace amount of an additive under the following conditions; temperature: 30° C., electric current: 200 A, and duration: 30 minutes. Thereafter, the connector was subjected to rinsing, rinsing in hot water, and then dewatering-drying.

COMPARATIVE EXAMPLE 1

A snap-in-fitting connector manufactured from a corson alloy (CAC60 manufactured by KOBE STEEL, Ltd.) was subjected to Cu—Sn plating only in the same manner as in Example 1 mentioned above.

TEST EXAMPLE

The snap-in-fitting connector composed of a couple of male connector member 40 and female connector member 60 which had undergone each plating processing according to Example 1 and Comparative Example 1 mentioned above was exposed to corrosive environment (vacuum drying process), and the connection resistance (contact resistance) before exposure and that after exposure were measured. Incidentally, the corrosive environment was a vacuum atmosphere at 160° C. for 72 hours, which was a humid atmosphere because of the drying of water.

Figure 42:
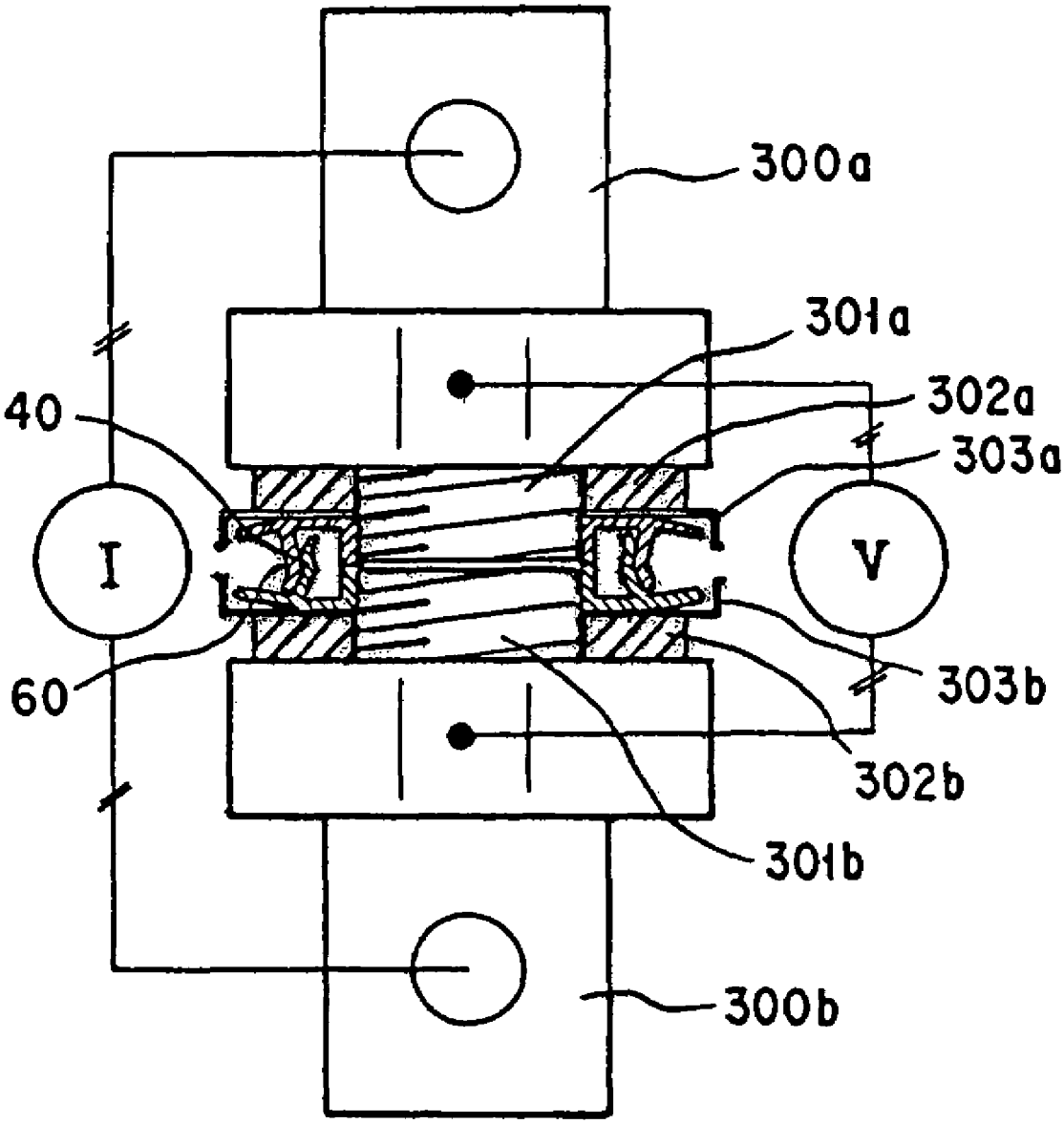
FIG. 42 is a fragmentary schematic cross-sectional view of the connection resistance measurement equipment used in a test example.

In the measurement of connection resistance, as shown in FIG. 42, the male connector member 40 and the female connector member 60 of each snap-in-fitting connector were attached to screw terminals 301*a*, 301*b* of a pair of upper and lower testing jigs 300*a*, 300*b* through the medium of ring-like insulating spacers 302*a*, 302*b* and washers 303*a*, 303*b* equipped with a collar, respectively, and then the male connector member 40 was fitted in the female connector member 60 of the snap-in-fitting connector as shown in FIG. 42 to measure the connection resistance. Incidentally, the measurement of connection resistance was performed under the conditions; measurement temperature: 25° C., measurement humidity: 10% or less, and measurement electric current: 250 A.

Figure 43:
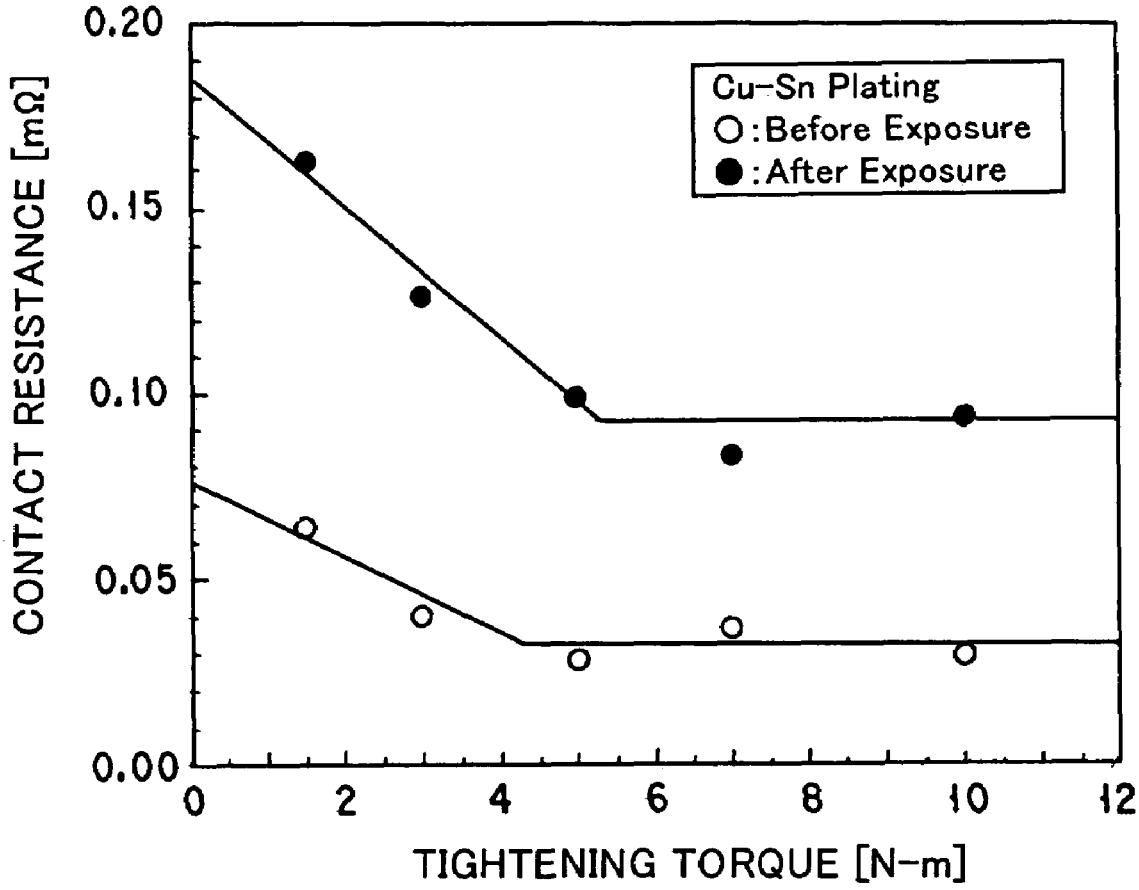
FIG. 43 is a graph showing the relation between the connection resistance and fastening torque of the connector (Ni/Cu—Sn/Sn three layers were plated) of the snap-in-fitting system prepared in Example 1.
Figure 44:
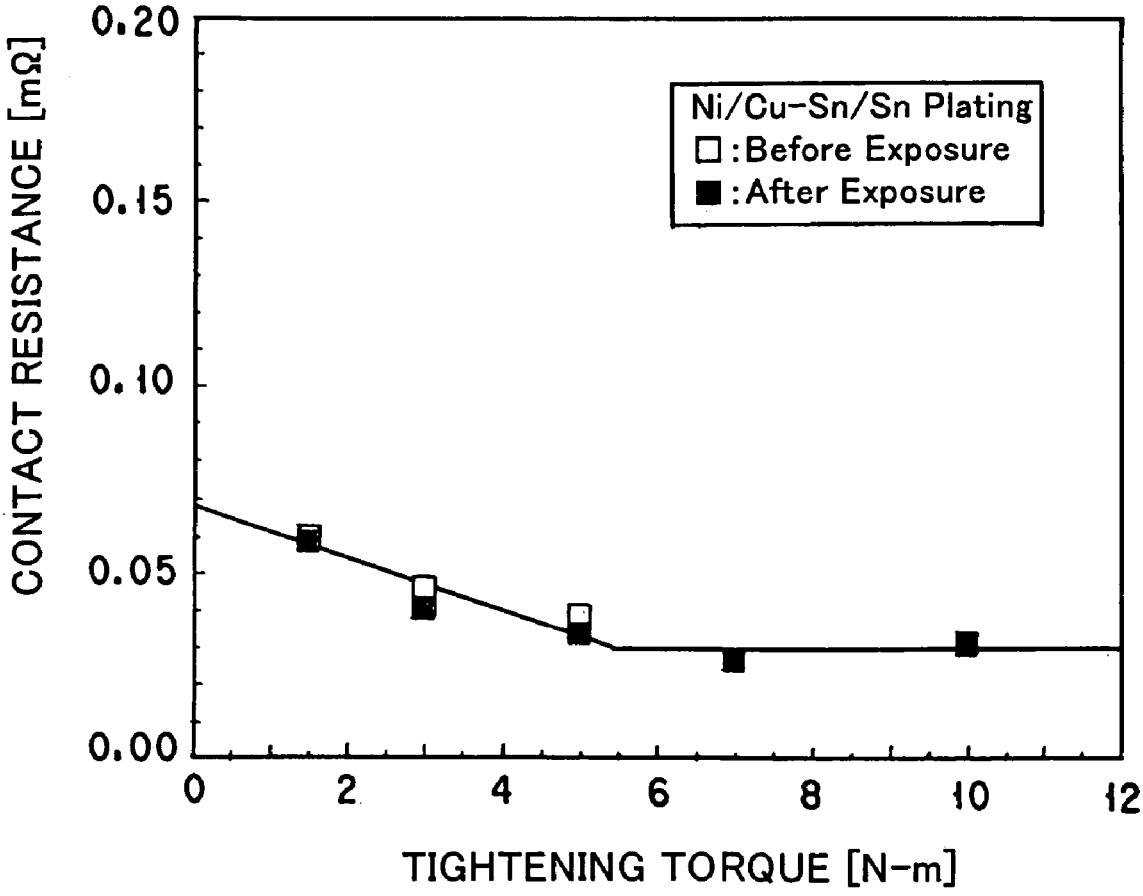
FIG. 44 is a graph showing the relation between the connection resistance and fastening torque of the connector (Cu—Sn layer was plated) of the snap-in-fitting system prepared in Comparative Example 1.

The measurement result of the connection resistance of the snap-in-fitting connector (Ni/Cu—Sn/Sn three layers were plated) prepared in Example 1 is shown in FIG. 43, and the measurement result of the connection resistance of the snap-in-fitting connector (Cu—Sn layer was plated) prepared in Comparative Example 1 is shown in FIG. 44.

As shown in FIG. 43, in the case of the snap-in-fitting connector of Example 1 on which the Ni/Cu—Sn/Sn three plating layers were formed according to the present invention, there was no change (increase) in resistance before and after exposure to corrosive environment. On the other hand, in the case of the snap-in-fitting connector of Comparative Example 1 on which only the Cu—Sn plating layer was formed, the contact resistance before exposure to corrosive environment increased remarkably by about 3 times after exposure, as shown in FIG. 44. In the case of the snap-in-fitting connector of Example 1 on which the Ni/Cu—Sn/Sn three plating layers were formed, it is considered that the diffusion of Cu in the base material to the plating layer was prevented due to the barrier effect of the Ni plating layer, and consequently the generation of CuO which will cause the increase in resistance was prevented. On the other hand, in the case of the snap-in-fitting connector of Comparative Example 1 on which only the Cu—Sn plating layer was formed, it is considered that only the Cu—Sn plating layer failed to prevent the diffusion of Cu in the base material to the plating layer, consequently CuO was produced, and the contact resistance increased. From the results of this test example, it will be concluded that the diffusion of Cu in a base material to the plating layer can be effectively prevented by forming the Ni plating layer as a primary coat of the Cu—Sn plating layer.

While certain specific embodiments have been disclosed herein, the invention may be embodied in other specific forms without departing from the spirit or essential characteristics thereof. The described embodiments are therefore to be considered in all respects as illustrative and not restrictive, the scope of the invention being indicated by the appended claims rather than by the foregoing description and all changes which come within the meaning and range of equivalency of the claims are, therefore, intended to be embraced therein.

The disclosures in Japanese Patent Applications No. 2005-144446, No. 2005-144516, No. 2005-144517, No. 2005-144518, and No. 2005-144519 all filed May 17, 2005 are incorporated here by reference. These Japanese Patent Applications describe the inventions described hereinabove and claimed in the claims appended hereinbelow and provides the basis for a claim of priority for the instant inventions under 35 U.S.C. 119.

What is claimed is:

1. A connection structure of storage cells comprising:

storage cells having terminals at respective ends; and male and female connector members both made of an electrically conductive material, wherein said female connector member comprises a base part having an inner hole which allows a storage cell terminal to be inserted therein, a female screw part formed in an inner circumferential surface around the inner hole engages said terminal, and a female engaging part for snap-in-fitting, said female engaging part standing from said base part so as to surround said inner hole, said male connector member comprises a base part having an inner hole which allows a storage cell terminal to be inserted therein, a female screw part formed in an inner circumferential surface around the inner hole engages said terminal, and a male engaging part to be fitted in and engaged with the said female engaging part by snap-in-fitting, said male, engaging part standing from said base part so as to surround said inner hole, and wherein an interaction part in snap-in-fitting of said male engaging part and said female engaging part is an inclined engaging surface and adapted to apply load to the female engaging part so as to always urge the female engaging part outward.

2. The electric connector according to claim 1, wherein said inclined engaging surface is a tapered surface convergent toward the male connector member side.

3. An apparatus for connecting terminals to be electrically connected by snap-in-fitting, which comprises;

a pair of terminals, an electric connector set forth in claim 1, and a cover unit for a connected part between terminals, which comprises a couple of male and female cover members each having a base plate containing an opening in the center thereof and a circumferential wall part of a predetermined height standing from the periphery thereof, the circumferential wall part of said male cover member being adapted to be guided into the circumferential wall part of said female cover member, wherein said male cover member and said female cover member of said cover unit are attached to respective terminals in the state of being nipped between either of said terminals and either of a male connector member or a female connector member of said electric connector.

4. A bus bar comprising a bus bar plate and an electric connector set forth in claim 1, wherein said electric connector has a male connector member fixedly secured to one end portion of said bus bar plate and a female connector member fixedly secured to the other end portion of said bus bar plate.

5. The electric connector according to claim 1, wherein said electric connector is a connector for storage cells, and wherein said male connector member and said female connector member have an attachment part for attaching to a terminal, respectively.

6. The electric connector according to claim 5, wherein at least one of said male connector member and said female connector member has an inner ring part standing from an inner circumferential edge around said inner hole of said base part, and said female screw part is formed in an inner circumferential surface of said inner ring part.

7. The electric connector according to claim 6, wherein said inner ring part has a slit or a groove portion on which said female screw part is not engraved.

8. The electric connector according to claim 7, wherein at least one of said male connector member and said female connector member has a knob part formed on an upper end of said inner ring part so as to extend from said groove portion outward in the radial direction of said inner ring part.

9. The electric connector according to claim 6, wherein said inner circumferential surface of said inner ring pan has a diameter decreasing from said base part toward an upper end thereof.

10. The electric connector according to claim 5, wherein said base part of at least one of said male connector member and said female connector member has a hole portion formed outside of said engaging part.

11. The electric connector according to claim 5, wherein said base part of at least one of said male connector member and said female connector member has a plurality of nail pieces projecting outward in the radial direction and formed in an outer edge thereof.

12. The electric connector according to claim 1, wherein at least one of said female connector member and said male connector member has a Ni plating layer and a Cu—Sn plating layer formed sequentially in the order mentioned on a copper-based base material, respectively.

13. The electric connector according to claim 12, further having a Sn plating layer formed on said Cu—Sn plating layer.

14. A storage cell comprising a pair of terminals for inputting and outputting electric power and an electric connector set forth in claim 1, wherein a male connector member of said electric connector is attached to one terminal and a female connector member of said electric connector is attached to the other terminal.

15. The storage cell according to claim 14, further comprising a cover unit for a connected part between terminals, which comprises a couple of male and female cover members each having a base plate containing an opening in the center thereof and a circumferential wall part of a predetermined height standing from the periphery thereof, the circumferential wall part of said male cover member being adapted to be guided into the circumferential wall part of said female cover member, wherein said male cover member and said female cover member of said cover unit are attached to respective terminals in the state of being nipped between either of said terminals and either of the male connector member or the female connector member of said connector.

16. A storage module comprising:

two or more storage cells, each having a pair of terminals for inputting and outputting electric power, for storing and discharging electric power through said terminals, and electric connectors set forth in claim 1 attached to said terminals, wherein said storage cells are adapted to be electrically connected to each other simultaneously with the fixation of relative positions of said respective terminals by said connector.

17. The storage module according to claim 16, wherein two of said storage cells are positioned adjacent each other such that respective terminals of said two storage cells are opposed to each other, said two storage cell having respective circumferential wall parts which at least partially define a closed connection space between said two storage cells, said respective terminals contained within the closed connection space, and said connector is positioned in the closed connection space when said respective terminals are electrically connected to each other by said connector.

18. The storage module according to claim 16, further comprising a cover unit for a connected part between terminals, which comprises a couple of male and female cover members each having a base plate containing an opening in the center thereof and a circumferential wall part of a predetermined height standing from the periphery thereof, the circumferential wall part of said male cover member being adapted to be guided into the circumferential wall part of said female cover member, wherein said male cover member and said female cover member of said cover unit are attached to respective terminals in the state of being nipped between either of said terminals and either of a male connector member or a female connector member of said connector.

19. A storage apparatus equipped with a plurality of storage modules set forth in claim 16.

20. A connection structure of storage cells comprising:

storage cells having terminals at respective ends;

a male connector member removably attached to one terminal of the storage cell and having an outer ring part and an inner ring part formed inside this outer ring part, said terminal being connected to said inner ring part; and a female connector member to be attached to the other terminal of the storage cell and having an outer ring part and an inner ring part formed inside this outer ring part, said terminal being connected to said inner ring part;

wherein said male connector member and said female connector member are connected to each other by abutting an end face of the inner ring part of said male connector faced to the axial direction thereof and an end face of the inner ring part of said female connector member faced to the axial direction thereof to each other and press-fitting an outer circumferential surface of the outer ring part of said male connector member and an inner circumferential surface of the outer ring part of said female connector member to each other.

21. The connection structure of storage cells according to claim 20, further comprising a washer which comprises a disk-like base part, a circumferential wall part formed along a peripheral edge thereof, and a collar extending outward in the radial direction from a top end of said circumferential wall part, wherein said washer is interposed and fastened between at least one of said male connector member and said female connector member and the terminal of said storage cell.

22. The connection structure of storage cells according to claim 20, wherein said male connector member and said female connector member have screw parts formed in inner circumferential surfaces of respective inner ring parts thereof, respectively, and a plurality of nail pieces projecting outward in the radial direction formed in outer peripheral edges of respective outer ring parts thereof, respectively, said nail pieces being an engaging portion of a predetermined tool to be used in the fastening of the screw parts.

23. The connection structure of storage cells according to claim 22, wherein the number of nail pieces of said male connector member is different from the number of nail pieces of said female connector member.

24. The connection structure of storage cells according to claim 22, wherein said nail pieces of said male connector member and/or said female connector member have a shape curved so as to be gradually raised in the radial direction and come close to the other party connector member.

25. A connection structure of storage cells according to claim 20 wherein, a unit for covering a connected part between storage cell terminals electrically connected by snap-in-fitting, which comprises a couple of male and female cover members each having a base plate containing an opening in the center thereof and a circumferential wall part of a predetermined height standing from the periphery thereof, wherein said male cover member is provided with a concave portion formed in an outside surface of its circumferential wall part and said female cover member is provided with a protruded portion formed in an inner surface of its circumferential wall part and adapted to be fitted in said concave portion so that the circumferential wall part of said male cover member is adapted to be guided and fitted into the circumferential wall part of said female cover member to effect snap-in-fitting.

26. The unit according to claim 25, wherein said circumferential wall part of at least one of the male and female cover members has a thickness so designed as to be thick on the base end side rather than the upper end side.

* * * * *